US008047285B1

(12) United States Patent
Smith

(10) Patent No.: US 8,047,285 B1
(45) Date of Patent: Nov. 1, 2011

(54) METHOD AND APPARATUS TO DELIVER ENERGY IN A WELL SYSTEM

(76) Inventor: David Randolph Smith, Kilgore, TX (US)

( * ) Notice: Subject to any disclaimer, the term of this patent is extended or adjusted under 35 U.S.C. 154(b) by 883 days.

(21) Appl. No.: 11/760,749

(22) Filed: Nov. 16, 2007

Related U.S. Application Data

(63) Continuation of application No. PCT/US2005/044544, filed on Dec. 9, 2005.

(60) Provisional application No. 60/593,103, filed on Dec. 9, 2004.

(51) Int. Cl.
*E21B 43/24* (2006.01)

(52) U.S. Cl. ..... 166/260; 166/58; 166/299; 166/300; 166/305.1

(58) Field of Classification Search ..... None
See application file for complete search history.

(56) References Cited

U.S. PATENT DOCUMENTS

| | | | |
|---|---|---|---|
| 2,680,487 | A | 6/1954 | Carpenter |
| 3,235,006 | A | 2/1966 | Hujsak |
| 4,372,386 | A | 2/1983 | Rhoades |
| 4,453,597 | A | 6/1984 | Brown |
| 4,475,596 | A | 10/1984 | Papst |
| 4,867,238 | A | 9/1989 | Bayless |
| 5,954,452 | A | 9/1999 | Goldstein |

FOREIGN PATENT DOCUMENTS

WO WO 02/103152 A1 12/2002

*Primary Examiner* — Zakiya W. Bates
(74) *Attorney, Agent, or Firm* — Fulbright & Jaworski, LLP

(57) ABSTRACT

The subject matter relates to an apparatus for insertion of a conduit into a well system bore to introduce a reactant fluid over a subterranean catalyst to initiate decomposition of the reactant fluid which resultant energy release may be utilized to perform work or perform heating of the subterranean environment. The energy released from the catalytic reaction and subsequent combustion of fuels may also be used for cutting, welding, powering pumps, compressors, turbines, generators, or to heat well system fluids, pipes, subterranean reservoir fluids, subterranean solids, and completion devices in the well system.

121 Claims, 12 Drawing Sheets

METHOD AND APPARATUS TO DELIVER ENERGY IN A WELL SYSTEM

CROSS REFERENCE TO RELATED APPLICATIONS

This application filed Jun. 9, 2007 is a continuation under 35 U.S.C. 120 of PCT international application PCT/US2005/044544 filed Dec. 9, 2005 with the U.S. Patent Office as receiving office which claims priority under 35 U.S.C. 119(e) to U.S. Ser. No. 60/593,103 filed Dec. 9, 2004.

BACKGROUND

The present invention relates to an apparatus and method to release energy and perform work with said energy release in a well system; more specifically, to release chemical energy in a well system utilizing at least one fluid transmitted down a continuous conduit disposed in a well or riser reacting said fluid across a subterranean catalyst to release energy in the well system.

More particularly a method to continuously supply a fluid to a down hole catalyst and apparatus for using the energy release of the catalytic reaction and any subsequent reaction of said fluid after the catalytic reaction to heat the subterranean environments claimed herein. This invention can also use said energy release to do useful work, such as but not limited to jetting perforations, drilling, cutting, welding, powering pumps, compressors, turbines, generators, or more simply heat well system fluids, pipes, subterranean reservoir fluids, subterranean solids, and completion devices in the well system. For example, the released energy can be used to cut a window in a casing for further down hole processing through such window or weld a junction in a multi-lateral well or otherwise create a weldment.

It is well known that the application of down hole energy in gas and oil well systems can be used to slot, or perforate, or cut off well tubulars. This is commonly done with high pressure water jets with abrasives or shaped explosive charges in the art of well perforating.

The use of abrasive fluid jets require large amounts of hydraulic horsepower to be generated on the surface and transmitted to the well depth required. Frictional losses in the transmission conduits, the accumulation in the well system of the abrasives, and the accumulation of the jetting fluid in the well system can provide limitations with existing technology.

The shaped explosive charges on the other hand release energy rapidly by means of a chemical reaction. These charges are ignited with various electrical and mechanical triggers. These explosive charges are very dangerous to transport, store, and handle on the surface and many people have been killed when the charges are set off on surface by accidental electrical excitation, like a radio being keyed up in the vicinity of the well where the explosives are being prepared on surface. Moreover, the explosive charges fire instantaneously such that they can only penetrate at a focused point in the well and hence many charges have to be used to penetrate various depths in the well system. Some explosive charges are not well suited for cutting slots, which yield more inflow area as is often required in wells that will require a gravel pack. This often means that many runs, for example runs of wire line deployed perforating guns, of explosive charges must be run in a well. Furthermore, the use of explosive charges, boosters, and the primer cord represents an extreme hazard to store and transport around the world. These charges, primer cord, and boosters can easily be used by groups that have evil intentions and hence the world wide use of explosive perforating in the oil and gas industry and the inherent storage, transport, and disposal of this explosive device represents a very difficult security challenge. These charges are very small and can be transported and concealed in shoes, toothpaste tubes, and many other stealthful methods. These explosive charges are used in hundreds of countries around the world, where oil and gas is produced and the continual monitoring of the storage sites and bunkers, the monitoring of their transport and movement becomes impossible.

The present invention allows for an improved method to transmit and release chemical energy down hole. The present real problem of security represented by the art of explosive well perforating is wholly avoided. Furthermore, the present invention can allow one trip down the bore to perform any service work involving perforating, avoiding the need for multiple trips down hole to perforate at different zones as bore hole conditions are experienced. Finally, the present invention solves the problem of high fluid friction losses present in current hydraulic jet cutting methods.

SUMMARY OF THE INVENTION

One embodiment of the present invention provides a conduit having a surface connection on a proximal end and at least one reaction chamber on a distal portion of the conduit which is disposed in a well system, a sensor located on the conduit between a distal end and the proximal end, a data line extending from the sensor to the surface connection, and a catalyst disposed within the reaction chamber. The catalyst can be disposed within the reaction chamber before or after the conduit is disposed in the well system. The reaction chamber can further comprise at least one bypass allowing a fluid to flow through the conduit without contacting the catalyst in a reaction chamber. The reaction chamber can be disposed in a side pocket mandrel. At least one side pocket mandrel or reaction chamber can be connected to a second conduit extending to a surface location. A second conduit can be connected between the surface connection and the reaction chamber. A conduit can be disposed inside a larger diameter second conduit. An apparatus can include at least one energy focusing orifice providing an outlet for the reaction chamber. A sensor can be disposed within the conduit. The conduit can include a continuous tube. The conduit can comprise stainless steel, at least 50% nickel, or be a cold worked tube. The conduit can include at least one unidirectional fluid check valve disposed therein. An outer surface of the conduit can include at least one orifice in fluid communication with a bore of the conduit.

In yet another embodiment, the reaction chamber contains energy released from the decomposition of a reactive chemical in the presence of the catalyst. The reactive chemical can be a peroxide. The reactive chemical can be hydrogen peroxide. The energy released can include energy released from the reaction of a fuel and a product of the hydrogen peroxide and catalyst decomposition. The fuel can comprise methanol, diesel, methane, oil, or sugar.

In another embodiment, the apparatus includes a conduit disposed in a well system, the conduit having a surface connection on a proximal end and at least one reaction chamber on a distal portion, a sensor located on the conduit between a distal and the proximal ends, a data line extending from said sensor to the surface connection, and a proportioning apparatus in fluid communication with the proximal end of the conduit and a reactive chemical tank. The apparatus can include a catalyst disposed in the reaction chamber. The apparatus can include a catalyst, fuel, or water tank in fluid communication with the proportioning apparatus. The apparatus can include at least one abrasive solid source in fluid communication with the conduit.

In yet another embodiment, the apparatus includes at least one jet disposed on an outer surface of the reaction chamber and in fluid communication therewith. At least one jet can be disposed adjacent a well system surface. The apparatus can include at least one fuel inlet port on the reaction chamber. The apparatus can include at least one electrical wire line sensor attached to the conduit or least one electrical conductor disposed within the conduit. The apparatus can include at least one ignition source connected to the electrical conductor. At least one electrical wire line sensor can be a gamma ray recorder, a casing collar locator, or a density neutron tool.

In another embodiment, the apparatus can include at least one optical fiber disposed within the conduit. The apparatus can include an optical time domain reflectometry device providing a light source to the optical fiber and interrogating a backscattered light parameter with the optical fiber for distributive temperature monitoring at a surface location.

In yet another embodiment, a method for selectively releasing energy in a well system can include disposing a conduit within the well system, the conduit having at least one reaction chamber on a distal portion, injecting a fluid from a surface location through the conduit and into contact with a catalyst disposed in the reaction chamber, the catalyst reacting with the fluid to release energy, and selectively releasing at least a portion of the released energy from the reaction chamber with at least one orifice. The fluid can be an oxidant. The fluid can be a peroxide. The fluid can comprise hydrogen peroxide. The fluid can be a blend of at least two fluids, wherein at least one of the fluids reacts and decomposes over the catalyst and at least one of the other fluids reacts with a product formed by the catalytic decomposition of the first fluid.

A method for selectively releasing energy in a well system can include injecting a fuel into the reaction chamber through the conduit or injecting a fuel into the reaction chamber through a second conduit disposed within the well system and extending from the surface location. The fuel can comprise methanol, diesel, methane, oil, or sugar. A method can include providing a unidirectional fluid check valve within the conduit between the reaction chamber and the surface location. The method can include disposing an electrical conductor within the conduit, the electrical conductor extending from the surface location to a sensor attached to the conduit.

In another embodiment, a method for selectively releasing energy in a well system includes disposing a conduit with at least one reaction chamber connected thereto into the well system through a dynamic hydraulic packoff on a proximal end of the well system, measuring a well characteristic with at least one sensor attached to the conduit, measuring a position of a portion of the conduit in the well system, correlating the position of the portion of the conduit with a location of interest in the well system, connecting the conduit at a surface location to at least one pump, connecting the pump to a fluid reservoir, and pumping the fluid through the conduit and into an entry port on at least one of the reaction chambers, the fluid reacting with a catalyst in the reaction chamber to release energy in the reaction chamber. The fluid can comprise comprises hydrogen peroxide. A method can include pumping a fuel into the reaction chamber from the surface location. A method can further comprise selectively releasing at least a portion of the released energy from at least one orifice on the reaction chamber.

In yet another embodiment, a method can further include disposing at least one of the orifices adjacent a location of interest in the well system and selectively releasing at least a portion of the released energy. A method can further comprise disposing at least one of the orifices adjacent a second location of interest in the well system and selectively releasing a second portion of the released energy. An adjacent surface of the well system can be perforated with a portion of the released energy.

In another embodiment, a method for selectively releasing energy in a well system comprises disposing a conduit with a plurality of reaction chambers disposed therein within the well system, at least one of the reaction chambers including an entry port in fluid communication with the conduit and an exit port in fluid communication with a bore of the well system, injecting a fluid from a surface location through the conduit and into contact with a catalyst disposed in at least one of the reaction chambers, the catalyst reacting with the fluid to release energy, and selectively releasing at least a portion of the released energy from at least one of the exit ports. A method can further comprise disposing at least one unidirectional fluid check valve in the conduit between the entry port on one of the reaction chambers and the surface location. The fluid can comprise hydrogen peroxide.

In yet another embodiment, a method for selectively releasing energy in a well system can further comprise lifting a well fluid within the bore of the well system with the portion of selectively released energy. A section of the bore of the well system can be cleaned with the portion of selectively released energy. The method can further include correlating the depth of at least one reaction chamber with a location of interest in the well system. The method can further comprise deploying at least one optical fiber within the well system.

In another embodiment, method for selectively releasing energy in a well system can further comprise creating, with optical time domain reflectometry, a temperature profile along a length of the well system using a distributed temperature survey device and the optical fiber. A method for selectively releasing energy in a well system can comprise providing a well system including a section of a formation in fluid communication with the well system, disposing a catalyst in the well system, propping open at least a portion of a formation with the catalyst, and injecting a fluid from a surface location through a conduit into the portion of the formation, the catalyst reacting with the fluid to release energy. The fluid can comprise hydrogen peroxide. The method can further comprise heating a portion of the formation with the released energy.

In yet another embodiment, at least one of the reaction chambers further comprises a jet pump in fluid communication with the exit port. A method for selectively releasing energy in a well system can include selectively releasing the released energy on a turbine, the turbine powering at least one stage of a pump or compressor. A method can include using the released energy to power a work extraction device disposed in the well system. A method for selectively releasing energy in a well system can further comprise heating a second fluid present in the bore of the well system with a portion of the released energy. The second fluid can be a well fluid, a drilling fluid, or a stimulation fluid.

In another embodiment, a method for selectively releasing energy in a well system can further comprising drilling a plug disposed within the well system with a turbine drill bit disposed on a distal end of the conduit, the turbine drill bit at least partially powered by a portion of the released energy. A method for selectively releasing energy in a well system can comprise disposing a first conduit with a reaction chamber attached thereto within the well system, the reaction chamber including an entry port in fluid communication with a second conduit extending from a surface location and an exit port in fluid communication with a bore of the first conduit, injecting a fluid through the second conduit and into contact with a catalyst disposed in the reaction chamber, the catalyst reacting with the fluid to release energy, and selectively releasing at least a portion of the released energy from the exit port into the bore of the first conduit. The first conduit can further comprise a plurality of reaction chambers attached thereto. The method can further comprise lifting a well fluid within the bore of the first conduit with a portion of the selectively released energy.

In yet another embodiment, a method for selectively releasing energy in a well system comprises injecting a media into the well system, disposing at least one reaction chamber on a distal portion of a conduit into the well system adjacent a location of interest in a formation, injecting a fluid from a surface location through the conduit and into contact with a catalyst disposed in at least one of the reaction chambers, the catalyst reacting with the fluid to release energy, selectively releasing at least a portion of the released energy from an exit port on the reaction chamber at the location of interest in the formation, and fusing the media to the location of interest with the released energy. A method can further comprise disposing the reaction chamber adjacent a second location of interest in the formation and fusing the media to the second location of interest by selectively releasing a second portion of the released energy.

In another embodiment, a method for selectively releasing energy in a well system comprises disposing a conduit within the well system, the conduit having a reaction chamber disposed on a distal portion thereof, injecting a fluid from a surface location through the conduit and into contact with a catalyst disposed in the reaction chamber, the catalyst reacting with the fluid to release energy, and drilling a formation by selectively releasing at least a portion of the released energy from the reaction chamber through a downward facing jet attached to and in fluid communication with the reaction chamber as the conduit is downwardly displaced.

In yet another embodiment, a method for selectively releasing energy in a well system further comprises producing a fluid from the formation through the conduit after drilling. A method can further comprise releasing a second portion of the released energy from a reverse thrust jet mounted on the conduit during drilling. A method can further comprise lifting a fluid within a bore of the well system with a portion of the energy selectively released from an exit port of a second reaction chamber disposed on the conduit, the second reaction chamber having an entry port in fluid communication with the conduit and an exit port in fluid communication with the bore of the well system. The conduit can further comprise at least one unidirectional fluid check valve disposed therein between the surface location and the entry port. A method can further comprise repeating the disposing, injection, and drilling steps with a second conduit containing a downward facing jet.

In another embodiment, a method for selectively releasing energy in a well system comprises providing a conduit having a reaction chamber disposed on a distal portion, injecting a fluid from a surface location through the conduit and into contact with a catalyst disposed in the reaction chamber, the catalyst reacting with the fluid to release energy, disposing the reaction chamber adjacent a plug previously disposed within the well system, and heating the plug with the released energy to deform the plug. The heating can be radiant heating. The plug can comprise lead, brass, or tin. The plug can comprise a chamber containing a second fluid that expands when exposed to a level of energy to deform the plug.

In another embodiment, a method for selectively releasing energy in a well system further comprises displacing the conduit in the well system while selectively releasing the released energy.

In yet another embodiment, a method for selectively releasing energy in a well system further comprises disposing an optical fiber within the well system, providing an optical time domain reflectometry device at a surface location, the optical time domain reflectometry device providing a light source to the optical fiber, and interrogating and recording a backscattered light parameter with the optical fiber in a time domain to create a temperature profile along a length of the optical fiber with the optical time domain reflectometry device.

In another embodiment, a method for selectively releasing energy in a well system comprises disposing a conduit within the well system, the conduit having a reaction chamber on a distal portion, connecting a proportioning apparatus to a source of a fuel, a source of a fluid, and a proximal end of the conduit, injecting a mixture of the fuel and fluid through the conduit and into contact with a catalyst disposed in the reaction chamber, the catalyst reacting with the mixture to release energy, and selectively releasing at least a portion of the released energy from at least one orifice in fluid communication with the reaction chamber.

In yet another embodiment, a method for selectively releasing energy in a well system comprises disposing a conduit within the well system, the conduit having a reaction chamber disposed on a distal portion, connecting a proportioning apparatus to a source of a catalyst, a source of a fluid, and a proximal end of the conduit, injecting a mixture of the fluid and catalyst through the conduit and into the reaction chamber, the catalyst reacting with the fluid to release energy, and selectively releasing at least a portion of the released energy from at least one orifice in fluid communication with the reaction chamber.

In another embodiment, a method for selectively releasing energy in a well system further comprises varying a ratio of the fluid and catalyst mixture with the proportioning apparatus. A method for selectively releasing energy in a well system can further comprise connecting the proportioning apparatus to a source of a fuel and injecting a mixture of the fluid, catalyst, and fuel into the reaction chamber. A method can further comprising varying a ratio of the fluid, catalyst, and fuel mixture with the proportioning apparatus. The fluid can comprise hydrogen peroxide.

In yet another embodiment, a method for selectively releasing energy in a well system further comprises forming a weldment with the released energy contained in the reaction chamber.

In another embodiment, a method for selectively releasing energy in a well system further comprising determining a depth of the conduit by correlating a previously run electrical log showing well depth and temperature to the temperature profile of the well system. A method can further comprise releasing a portion of the released energy from the reaction chamber into a fluid stream flowing in the well system to heat the stream, tracking a velocity of the energized well fluid using the temperature profile, and estimating a fluid flow measurement in the well system by using the fluid velocity and a known volume of the well system.

In another embodiment, an apparatus comprises a continuous conduit disposed in a well bore with a reaction chamber attached to a distal portion and a proximal end attached to a reel by a hydraulic swivel at a surface location, the continuous conduit having at least one unidirectional fluid check valve disposed therein and the hydraulic swivel in fluid communication with the continuous conduit, an injector head removably sealing the continuous conduit to a well system during conduit displacement without pressure loss in the well system, the well system comprising a hydraulic pack off removably sealing an outer diameter of the continuous conduit to the well bore, a lubricator sealingly engaged to a blow out preventor, the blow out preventor sealingly engaged to a well head, the well head sealingly engaged to the well bore, a pump in fluid communication with the continuous conduit, the pump connected to a fluid tank, a data transmission, receiving, and collection apparatus, at least one sensor attached to the continuous conduit, and a data transmission line disposed in the continuous conduit and connected to the sensor and the data transmission, receiving, and collection apparatus.

A method for selectively releasing energy in a well system can further comprise adding an abrasive material to the fluid. A method can further comprise injecting a recovery fluid from the surface location through the conduit into contact with the catalyst, the recovery fluid recovering at least a portion of the catalyst's catalytic characteristics. The recovery fluid can be an acid.

In another embodiment, a method for selectively releasing energy in a well system comprises disposing a conduit within the well system, the conduit having a reaction chamber on a distal portion, and injecting a fluid from a surface location through the conduit and into contact with a catalyst naturally occurring in the well system, the catalyst reacting with the fluid to release energy.

In yet another embodiment, a method for selectively releasing energy in a well system comprises disposing in the well system a conduit having a surface connection on a proximal end and a sand screen disposed on a distal portion, the sand screen at least partially constructed of a catalyst, and injecting a fluid from a surface location through the conduit and into contact with the catalyst, the catalyst reacting with the fluid to release energy.

In another embodiment, a method for selectively releasing energy in a well system comprises disposing in the well system a conduit having a surface connection on a proximal end, a sand screen disposed on a distal portion, and a catalyst disposed between an outer diameter of the conduit and an inner diameter of the sand screen, and injecting a fluid from a surface location through the conduit and into contact with the catalyst, the catalyst reacting with the fluid to release energy.

In yet another embodiment, a method for selectively releasing energy in a well system comprises disposing in the well system a conduit having a surface connection on a proximal end and a sand screen disposed on a distal end, disposing a gravel pack between an outer diameter of the sand screen and an inner diameter of the well system, the gravel pack including a catalyst, and injecting a fluid from a surface location through the conduit and into contact with the catalyst, the catalyst reacting with the fluid to release energy. The fluid can be a mixture of fluids from a proportioning apparatus.

In another embodiment, an apparatus comprises a conduit disposed in a well system having a surface connection on a proximal end and a sand screen disposed on a distal portion, the sand screen at least partially constructed of a catalyst, a sensor located on the conduit between the proximal and a distal ends, and a data line extending from the sensor to the surface connection.

In yet another embodiment, an apparatus comprises a conduit disposed in a well system having a surface connection on a proximal end and a sand screen disposed on a distal end, a catalyst disposed between an outer diameter of the conduit and an inner diameter of the sand screen, a sensor located on the conduit between the proximal and the distal ends, and a data line extending from the sensor to the surface connection.

In another embodiment, an apparatus comprises a conduit disposed in a well system having a surface connection on a proximal end and a sand screen disposed on a distal end, a gravel pack disposed between an outer diameter of the sand screen and an inner diameter of the well system, the gravel pack including a catalyst, a sensor located on the conduit between the proximal and the distal ends, and a data line extending from the sensor to the surface connection.

In another embodiment, a method for inserting a reaction chamber into a well system comprises inserting into the well system a reaction chamber into a previously installed side pocket mandrel, and connecting the reaction chamber in the side pocket mandrel to form a hydraulic communication with a previously disposed conduit connected to the side pocket mandrel.

In yet another embodiment, a method for retrieving a reaction chamber from a well system comprises disposing a side pocket kick over into a side pocket mandrel, latching to a fishing neck on the reaction chamber, jarring the reaction chamber from the side pocket mandrel, and removing the reaction chamber from the well system.

BRIEF DESCRIPTION OF THE DRAWINGS

FIG. 1(*b*) is a schematic drawing of the apparatus of FIG. 1(*a*) adjacent a second zone in a well system after forming a perforation in the first zone.

FIG. 1(*c*) is a schematic drawing of the apparatus of FIGS. 1(*a*) and 1(*b*) after the first and second zones in the well system are perforated.

DETAILED DESCRIPTION

Figure 1A:
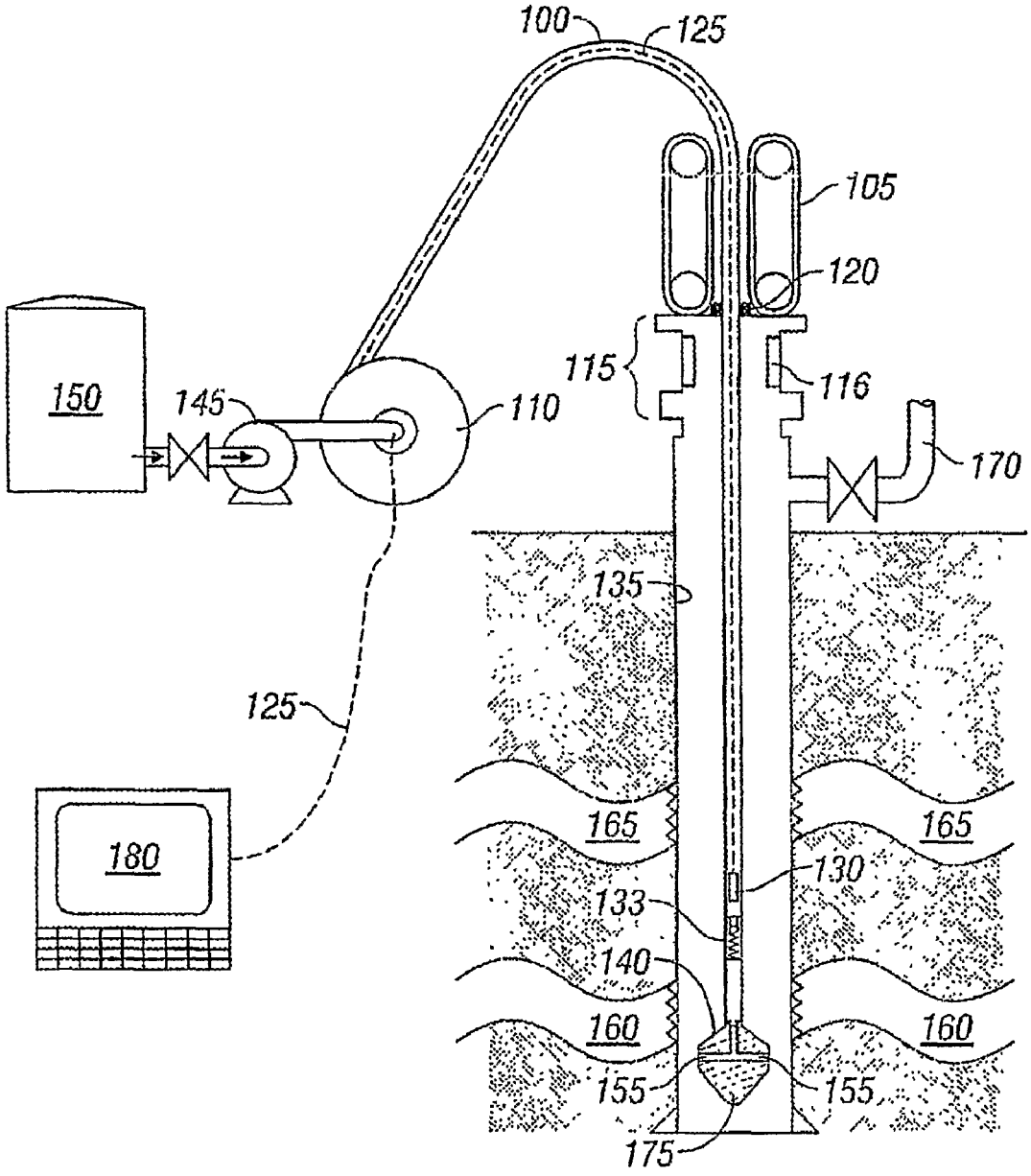
FIG. 1(*a*) is a schematic drawing of a conduit with a reaction chamber attached thereto adjacent a first zone in a well system, according to one embodiment of the invention.
Figure 1B:
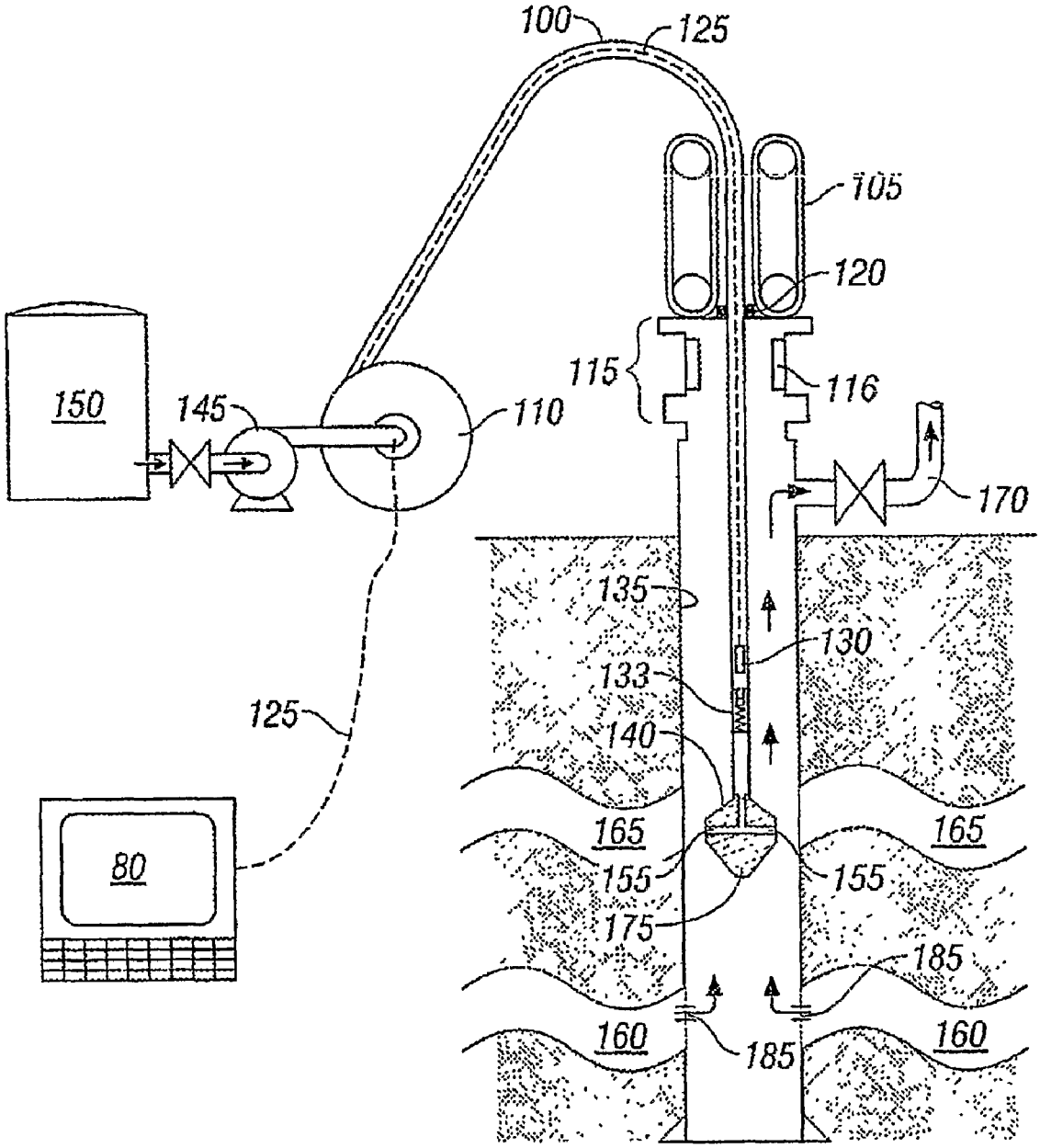
Figure 1C:
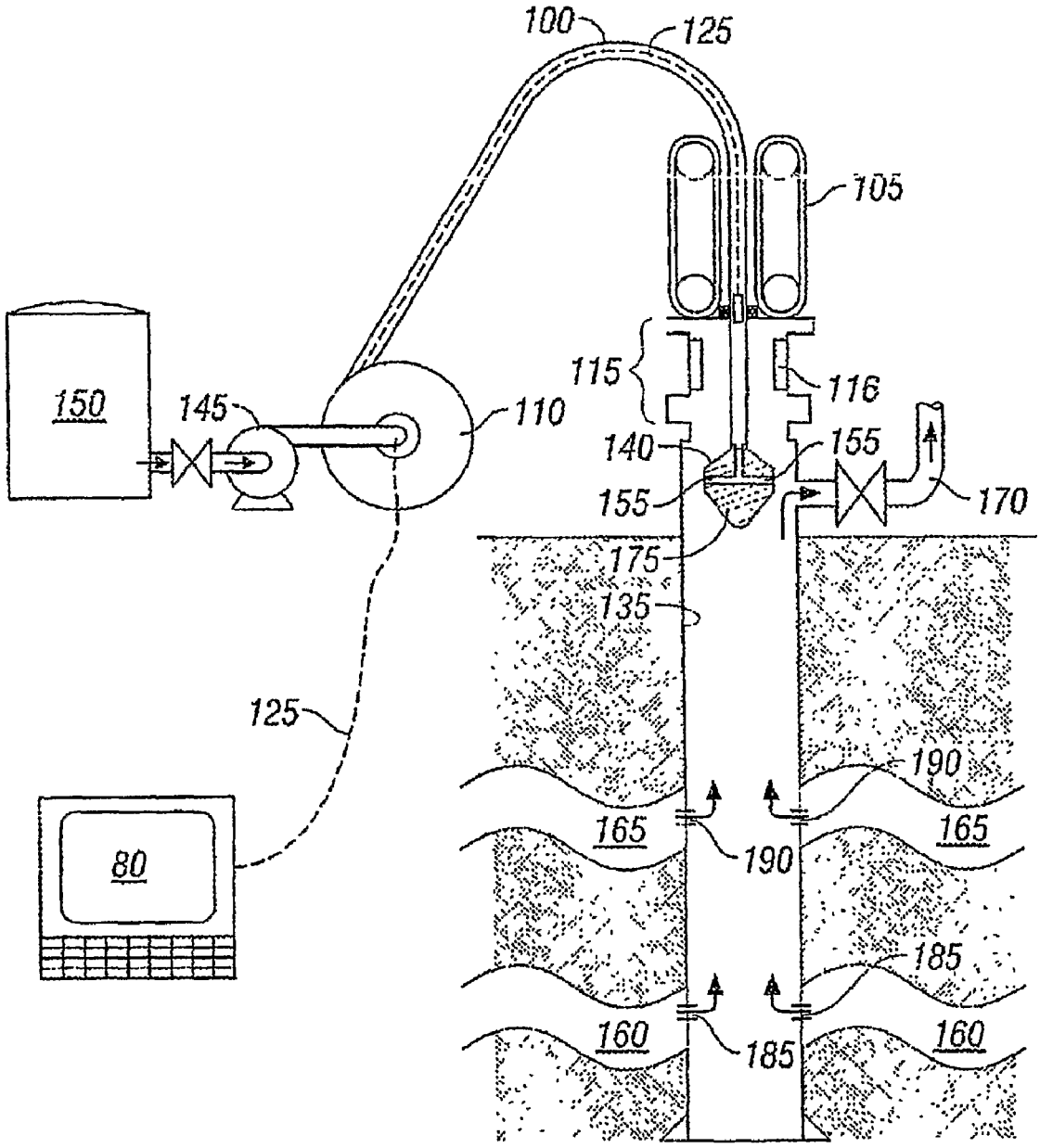

FIGS. 1(*a*), 1(*b*), and 1(*c*), where like elements are indicated with like numbers, discloses a schematic of one embodiment of the present invention showing a bore 135 of a previously drilled and cased well system of, for example, an oil and gas well.

The term "well system", as used herein, shall refer to any bore, well, or oil field drilling or production equipment. For example, a "well system" may include flow lines from well head to the host platform in a sub-sea well.

A conduit 100 is inserted into a well system which may be include traversing an injection head 105 and well head devices 115 (including a blow out preventor, etc.) as shown here. The conduit 100 may extend from a surface connection which, in FIGS. 1(*a*)-1(*c*), includes a conduit reel spool 110 located at a surface location. The proximal connection of the conduit 100 may also be secured to a wellhead hanger assembly (not shown), all in a manner well known in the art. A hydraulic seal 120 may also be used to prevent pressure loss from the well system. A data line 125 can be disposed either interior or exterior to the conduit 100 to connect a sensor 130 which can be affixed adjacent a distal portion of the conduit 100, either externally or internally, to measure well conditions, for example temperature, flow rates, resistivity, or any of the other variables commonly measured in well systems in this art field. The sensor 130 can be a gamma ray recorder, a casing collar locator, a density neutron tool, or a distributed temperature sensor. The sensor 130 can be utilized to determine the location of the reaction chamber 140 within the well system, thus an operator may selectively commence the reaction to achieve a desired result.

At the distal end of the conduit 100, a reaction chamber 140 is provided to house the reaction of any fluids and/or catalyst therein. In one embodiment, the fluid is injected into a conduit 100 by an optional pump 145 from a reservoir or tank 150 through an attachment to either the conduit 100 at the reel 110 or through a fitting in a manner well known in the drilling or coiled tubing industry. The fluid can include any reactant fluid that is decomposed with an exothermic reaction over a catalyst or that releases oxygen when decomposed over a catalyst. The fluid can be peroxide. Hydrogen peroxide is an example of a highly reactive yet widely available chemical that produces energy.

The term "energy", as used herein, shall refer to the energy and/or heat released from a catalytic reaction and may include thermal energy. The released energy may include the decomposed reactant fluids. The energy can be released ("released energy") for example in a reaction chamber or well system bore. If housed in a reaction chamber, the "released energy" may be selectively released therefrom as desired. The energy can be used as a heat source without releasing any of the reactant fluids from a reaction chamber 140, for example radiant heating a well bore or formation fluid flowing adjacent an outside surface of the conduit 100. The energy can be used to drive a turbine interior to the reaction chamber 140 or a motor (not shown) to provide either mechanical or electrical energy which can be used to perform work, for example to directly power a pump or compressor with the energy released from the reaction chamber or converting the energy released from the reaction chamber into mechanical or electrical energy which can power a pump or compressor.

An ignition device may also be located within the reaction chamber 140 to initiate the chemical reaction as needed. The conduit 100 may be concentrically disposed within a production or drilling tubular and/or used to heat or energize a fluid therein.

The injected fluid can further include a fuel, for example methanol, diesel, sugar, oil, or methane. The invention may include a second conduit (not shown) extending from the surface location to a fuel inlet port on the reaction chamber 140. The energy and/or reactant fluid and/or fuel mixture can be jetted out through an energy focusing orifice 155 against a location of interest. Although two orifices 155 are shown, the invention may include one orifice or a plurality of orifices. An orifice can be disposed on the reaction chamber or the conduit. The orifice can be or include a jet, as is know in the art.

The reaction chamber 140 in FIG. 1(*a*) is shown adjacent a first location of interest, for example a first hydrocarbon bearing zone 160. The reaction of the fluid, for example hydrogen peroxide, can be assisted by the use of a catalyst 175 disposed in the reaction chamber 140. The catalyst 175 can be wafer or granular. The catalyst 175 may be disposed in a well system and/or reaction chamber 140 on a wafer, screen, or body as is well know in the art of rocket science. The catalyst 175 can further be a solid or liquid. The catalyst 175 can be of any suitable type, preferably one that vigorously reacts with a reactant fluid, for example a peroxide such as hydrogen peroxide, to release energy. The catalyst 175, for example, can be selected from the group of transition metals and transition metal compounds consisting of compounds of cobalt, manganese, silver, alumina, iron, palladium, rhodium, platinum, gold, and combinations thereof. Any metal oxide, for example iron oxide, may be a suitable catalyst 175. A reaction chamber 140 is not required to use the same type or amount of catalyst as other reaction chambers, if present.

The design, volume, and/or shape of the reaction chamber 140 and/or catalyst 175 may be tailored for a particular application, for example the based on the amount and/or time of energy production desired. In the case of a stimulation or cleaning job, the amount of catalyst required does not have to last more than several hours, but in a permanent completion, a longer lasting catalyst or amount of catalyst 175 may be desirable. A catalyst 175 can be disposed down the conduit 100 while the reaction chamber 140 remains in the bore 135 of the well system using any means known in the art, which includes pumping a catalyst fluid mixture, using a liquefied catalyst, or physically inserting the catalyst with a well tool or other means. The energy released by the reaction of the fluid and catalyst 175 can be used to perorate an uncased section of the well system (not shown) or used against the wall of the well system bore 135 to perforate the wall, thereby releasing trapped hydrocarbons to flow up through the well system bore 135 to a production outlet 170. The energy can be used down hole for jetting, cutting, welding, steam cleaning the well system, or stimulating the reservoir. For example, the energy released may be utilized to remotely weld, patch split casing or junctions, or cut junk in the well system.

The amount of energy produced and/or released can be controlled by any means known in the art, for example changing the size and/or shape of an orifice 155, adding a valve to an exit port or orifice 155 for controlling the egress of reactant fluids and/or energy, or regulating the amount of fluid, fuel, and/or catalyst that is injected with the pump 145. A data transmission, receiving, and collection apparatus 180 at the surface is shown schematically connected to a data line 125. The data transmission, receiving, and collection apparatus 180 may be any kind known in the art, and is not limited to a single apparatus for all the transmission, receiving, or collection functions.

The conduit 100 may be a cold worked tube or a continuous tube, for example coiled tubing. The conduit 100 may also be a cold worked continuous tube or high nickel alloy, for example one having a composition of approximately 58% nickel, 20-23% chromium, 5% iron, 8-10% molybdenum, 3.15-4.15% niobium (plus tantalum), 0.10% carbon, 0.50% manganese, 0.50% silicon, 0.015% phosphorous, 0.015% sulfur, 0.40% aluminum, 0.40% titanium, and 1% cobalt, such as Inconel alloy 625 from Special Metals. Cold working the conduit 100 may increase the conduit's tensile strength without significantly reducing the corrosion or chloride stress resistance.

The conduit may include, but is not limited to, stainless steel, nickel, titanium, a high percentage nickel alloy, a super elastic titanium nickel alloy, all of which may be suitable for use in the caustic environment of a well system. A shaped memory or super elastic alloy may also be used, such as a titanium nickel alloys, to permit the manipulation of the shape of the conduit 100 after insertion into the bore 135 of the well system. The conduit 100 may include an optional unidirectional fluid check valve 133 at any point between the conduit and an entry port to the reaction chamber 140. Each conduit 100 may be disposed with at least one unidirectional fluid check valve 133 to prohibit migration of reaction products, oil and/or gas through the conduit 100 to the surface.

In FIG. 1(*b*), the reaction chamber 140 is shown in a second position adjacent a second zone of interest 165 in the bore 135 of the well system. The conduit 100, and thus a connected reaction chamber 140, can be moved before, during or after the energy is released. Either may be moved by any means known in the art, for example using the reel 110, a hydraulic injector head, or otherwise acting at a surface location. A first set of perforations 185 are formed by the release of energy when the reaction chamber 140 is in the position shown in FIG. 1(*a*). A formation or well fluid may then be produced out of surface tubing 170 if so desired. After the reaction chamber 140 is moved adjacent to the second zone of interest 165, which may be a second hydrocarbon bearing zone, the energy can be released from the orifices 155 to form a second set of perforations (190 in FIG. 1(*c*)). Although the catalyst 175 is shown as substantially the same mass as in FIGS. 1(*a*)-1(*c*), it may decrease depending on the amount of fluid added and/or energy produced or released.

In FIG. 1(*c*), the reaction chamber 140 is shown disposed near a proximal end of the bore 135 of the well system. FIG. 1(*c*) illustrates the second set of perforations 190 in the second zone of interest 165 formed during the second energy release. Although each set of perforations (185, 190) is shown in pairs, the invention is not so limited.

To use the invention of FIGS. 1(*a*)-1(*c*), a conduit 100, which may be disposed on a reel 110 that can have a slip ring that allows for fluid communication and data communication to be made with the inside of the reel 110 and the bore of the conduit 100. The conduit 100 may have a data line 125 and/or sensor(s) 130 predisposed inside prior to arriving at the well system site. At the well system site, the conduit 100 may be threaded through an injection head 105, hydraulic seal 120, and well head device 115, such as, but not limited to, work windows 116 and/or lubricator (not shown) located above a tubing hang off table, i.e. such that the conduit 100 may be inserted into the bore 135 of the well system. The various catalytic reaction chambers, down hole tools, turbines, motors, recorders, weight bars, etc. may be connected to the conduit 100 as it is run through the lubricator (not shown).

If a reaction chamber 140 and/or orifice 155 is connected above the bottom or distal end of the conduit, this attachment can be performed through a work window 116 and using blow out preventors and hydraulic seals. Any length of conduit 100 previously disposed in the well system may be hung with a temporary hanger or slip assembly while the different devices that will be located above the distal end of the conduit 100 are connected, for example a reaction chamber 155, using welding methods or mechanical ferruled fittings. Once the conduit 100 is lowered to a desired depth in the bore 135 of the well system, a fluid, for example an 80% hydrogen peroxide and methanol mixture, may be injected from a surface location into a reaction chamber 140 and react with a catalyst 175, if present. The fluid may be a mixture of a first fluid that reacts and decomposes over the catalyst 175 and a second fluid that reacts with a product formed by the catalytic decomposition of the first fluid.

The decomposed reactant fluids or energy may then exit an orifice 155 on the reaction chamber 175. The orifice 155 can be positioned in the well system to apply the energy down hole for jetting, cutting, welding, steam cleaning the pipe, or stimulating the reservoir. A recovery fluid, such as an acid, can be pumped from the surface location into contact with the catalyst 175 to enhance or recover a portion of the catalyst's catalytic characteristics and/or prepare the conduit for the transport of a reactant fluid which may include hydrogen peroxide. For example, when using silver oxide as a catalyst 175, one can periodically pump a recovery fluid such as nitric acid into contact with the catalyst 175 every 30 minutes to enhance, maintain, and/or recover at least a portion of the catalytic nature of the silver oxide.

The conduit 100 may be extracted from the well system while pumping the fluid from the surface. This may cut slots in the reservoir and/or casing of the well system or simply clean the internal diameter of the well system. The conduit 100 may be displaced while in the well system, which may cause a reaction chamber 140 to be moved up and down in the well system as required while the fluid is being pumped down from surface and decomposed and exiting the reaction chamber as energy. The conduit 100 may also be stationary while the fluid is being injected and/or pumped. This can allow the energy from catalytic decomposition to be used to heat the well system and/or the reservoir.

The conduit 100 may then be position at a second desired location in the well system such that the reaction chamber 140 is at a different level in the same well system to allow for the perforating, stimulating, and/or cleaning of another location. As shown in FIG. 1(*b*), surface tubing 170 can be opened to allow the well fluid and/or the exhausted injected fluid (reactant fluid) to flow to the surface. One may also leave the surface tubing 170 closed so that the exiting decomposed fluids and energy would be injected into the reservoir. One skilled in the art of well completions and stimulation may both inject the energy released down hole by this invention's catalytic decomposition of fluid into the reservoir for extended periods of time, like in a steam injection cycle or an acid stimulation treatment, and then later allow the decomposed fluid and well fluid, as well as the energy released down hole in the well system by this invention, to flow to the surface.

Furthermore, a second fluid such as an acid, solvent, or a gas can be injected down the bore 135 of the well system through the surface tubing 170 with a reaction chamber 140 disposed adjacent a first reservoir 160, or later dispose the reaction chamber 140 adjacent the first reservoir 160. When the second fluid is at the reservoir depth it can be continually pumped and injected into the reservoir while the fluid, for example hydrogen peroxide, and other chemicals blended in the fluid pass through this inventions conduit 100 and reaction chamber 140 are exhausted into the second fluid to heat and gasify said second fluid prior to it entering the formation. This gives the reservoir an additional stimulation effect from the heat and the gas exhausted as energy from this inventions catalytic reaction.

The energy released by the invention's apparatuses and methods may allow a reduction in the diameter of a conduit 100 used within a well system bore 135, to drill or clean for example, as compared to the typically sized drill pipe utilized with surface rotary rigs or coiled tubing drilling with down hole hydraulic motors powered by surface pressurized drilling mud, as less of the energy required down hole for the drilling or cleaning need be generated hydraulically at a surface location.

Figure 2:
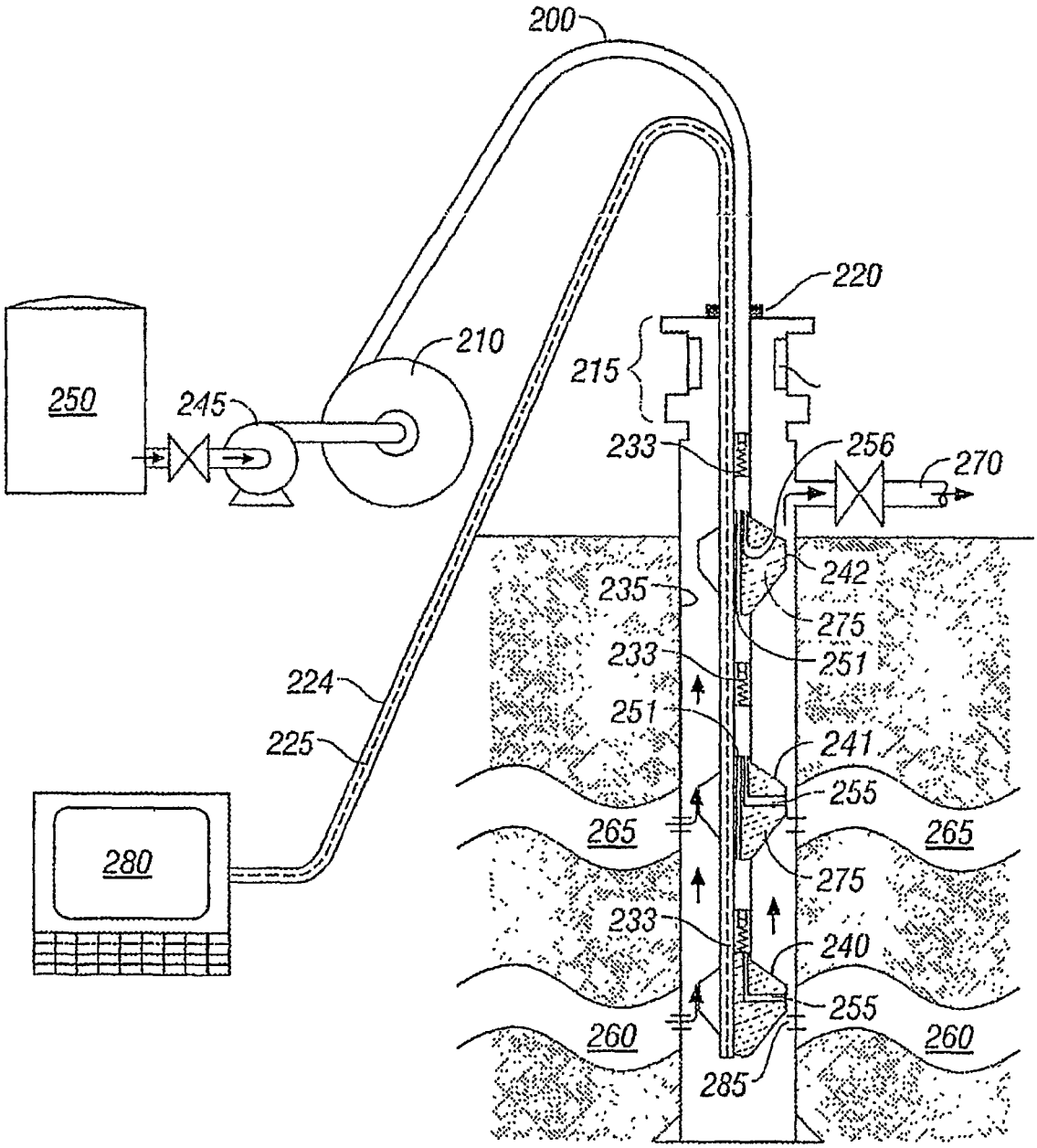
FIG. 2 is a schematic drawing of a conduit with multiple reaction chambers attached thereto disposed in a well system, according to one embodiment of the invention.

In FIG. 2, another embodiment of a conduit 200 is shown with multiple reaction chambers (240, 241, 242). A proximal end of the conduit 200 is connected to a reel 210 which can allow deployment and retrieval of the conduit 200. A first 242 and second 241 reaction chamber may include a bypass 251 to allow the fluid to flow past a respective reaction chamber. The bypass 251 is not present, but may be included, on the reaction chamber 240 disposed on the distal end of the conduit 200. A bypass 251 can allow a portion of the fluid pumped into the conduit 200 to by pass at least one reaction chamber (241,242) thereby not decomposing a portion of the reactant fluid across the catalyst 275 of said reaction chamber (241, 242) while a portion of the reactant fluid may flow into at least one subsequent reaction chamber 240 and be decomposed across at least one catalyst 275 therein. Optional check valves 233 are shown in the conduit 200 upstream of each reaction chamber (240-242).

A fluid, for example hydrogen peroxide or other reactant fluid, is injected through the conduit 200 from the tank 250 by the pump 245 to an entry port of a reaction chamber (240-242). If present in a reaction chamber (240-242), a catalyst 275 may react with the fluid to release energy. The energy may be released from an orifice or exit port (255, 256) on the reaction chamber (240-242). The orifice 256 may be angled, for example angled upward to aid in the lifting of a well system bore fluid. Although a single orifice (255, 256) is shown on each reaction chamber (240-242), a plurality of orifices may be used. FIG. 2 further shows two zones of interest (260, 265) with perforations (285, 290) which may have been formed by a previous release of energy. The conduit 200 may be rotated to allow different areas to be perforated or otherwise be contacted by the energy. The reaction chambers (240-242) may allow rotation by adding a swivel joint assembly (not shown) between the conduit 200 and reaction chambers (240-242) to allow the energy released from an orifice (255, 256) to rotate the reaction chambers (240-242).

An inner surface of a well system may be cleaned by releasing a small amount of small amount of energy, which may include a small amount of decomposed fluid, onto the well system bore 235. The release of energy may also have the added effect of lifting any well system bore 235 fluid due to the energy added to said fluid from the catalyst, fluid, and/or fuel reaction. This may allow heavy oil to be moved up the well system bore 235 and optionally out the surface tubing 270 with less viscosity, a gas to be lifted with the energized reactant products (energy), a gas to be heated to eliminate or melt hydrates, or paraffin to be continually avoided or removed from the well system. The pump 245 can be adjusted to optimize the amount of fluids injected, the blends of the fluids pumped can be altered using additional tanks and a proportioner, and thus optimize the energy released, in the well system. One skilled in the art may use a timer or other controller to further optimize the fluid pumping rate and amount of time the fluid, for example hydrogen peroxide, is injected in a well system. It is further understood that this invention teaches the application of heating risers of offshore wells and/or pipelines with the use of single or multiple reaction chambers (240-242) disposed in or on the conduit 200.

An optional second conduit 224 is shown extending from the surface location to an area adjacent the distal reaction chamber 240 and housing an electrical conductor 225. The electrical conductor can be connected to an ignition source disposed within the conduit and/or reaction chamber. The electrical conductor can be replaced or accompanied by an optical wave guide like an optical fiber. The optional second conduit 224 can house an electrical conductor, an optical fiber, and/or other energy wave guide. The data transmission, receiving, and collection apparatus 280 can be a laser distributed temperature survey (DTS) machine. As is known in the art, an optical fiber 225 can act as a distributive temperature sensor by using optical time domain reflectometry (OTDR) backscattering of light interrogation methods with the DTS machine. OTDR and DTS are discussed in U.S. Pat. No. 5,163,321, hereby incorporated by reference. OTDR and/or DTS can be used to determine a temperature profile along a length of optical fiber 225. The optical fiber 225 is used as a sensor to log the temperature along a length of the optical fiber, thus giving a surface indication of the reaction temperatures down hole and allowing the well system fluid heated by the exothermic reaction of the decomposition of hydrogen peroxide across the catalyst 275 to be tracked for velocity. By interrogating by light pulse, a temperature profile can be created for the bore 235 of the well system as the first conduit 200 is lowered or raised. By correlating the velocity of the heated fluid as it flows in the well system, and knowing the volume of the well system tubular the well fluid is flowing in, this method then becomes a flow meter with measurements at all points along the well. This allows one to discern the flow rates from different commingled reservoirs. The optical fiber 225 may also be run inside of the conduit carrying the fluid to be injected, as shown in FIGS. 1(*a*)-1(*c*).

Releasing energy at multiple points along a heavy oil well system may aid in steam and/or heat treating a well system as there can be a tremendous loss of energy when pumping steam in steam floods to the shallower depths. In the special case of Steam Assisted Gravity Drainage (SAGD), two parallel bore holes are drilled. One bore has steam pumped into it and the other allows the heavy oil to flow therein. This invention can be used in SAGD. A reaction chamber (240-242) can be run into either or both bores and using a first set of reaction chambers (240-242) disposed on a conduit 200 in the first bore to heat the reservoir and form the "steam chamber" in the reservoir where the heavy oil seeps into, and a second set of multiple reaction chambers (240-242) disposed into the second bore on its respective conduit (not shown) to lift the heavy oil from the second parallel bore, typically below the first bore, by gas lift type application with the added benefit of the heat reducing the viscosity of the heavy oil.

Figure 3:
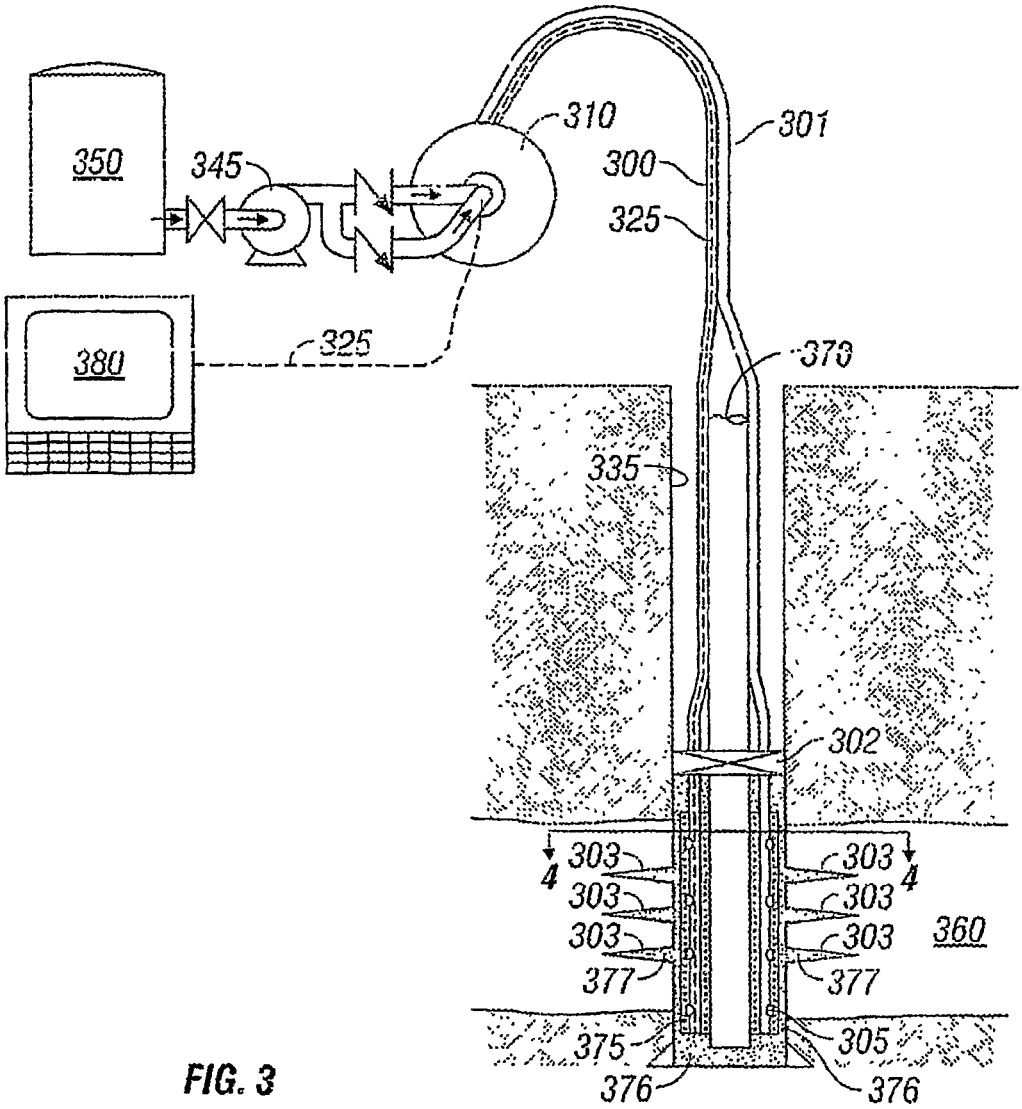
FIG. 3 is a schematic drawing of a sand screen disposed in a well system, according to one embodiment of the invention.
Figure 4:
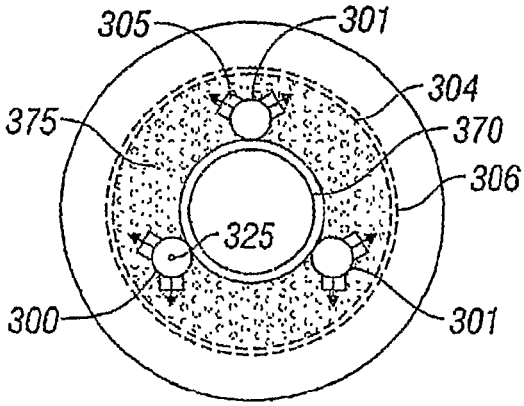
FIG. 4 is a sectional view of the sand screen of FIG. 3 seen along the line 4-4.

FIG. 3 is another embodiment for selectively releasing energy in a well system. FIG. 4 is a sectional view of the sand screen 304 of FIG. 3 along the line 4-4. In this embodiment, the catalyst 375 is disposed inside the sand screen 304. This sand screen 304 can be run off a drilling or work over rig as is common practice in the oil and gas industry, with a reel 310 of conduits (300, 301) shown banded to the outside diameter of the production tubing 370. Additionally, the sand screen 304 may be constructed from and/or plated with a catalyst.

Although three sections of conduit (300, 301) are shown here, the invention can include one of more conduits. The conduits (300, 301) in this embodiment are connected on a distal end to the sand screen 304 by a wire wrap 306 and on a proximal end to a reel 310, pump 345, and a fluid tank 350, which may include hydrogen peroxide. One conduit 300 includes an optical fiber 325 disposed therein. Optionally, a packer 302 may be used to help retain any fluid and/or energy below said packer 302 in the bore 335 of the well system.

In use, a fluid is pumped from the fluid tank 350 down at least one conduit (300, 301) from the surface into contact with the catalyst 375 in the well system. This energy release may occur anytime it is desired to cause the sand screen environment to heat up. The energy release may remove solids, heat heavy oil, or consolidate solids. The fluid, for example hydrogen peroxide, may be pumped from the surface down any conduit or a plurality of conduits (300, 301) and into contact with the catalyst 375 disposed in the sand screen 304. A conduit (300, 301) can have at least one orifice 305 such that the fluid contacts the catalyst 375 disposed in the sand screen 304, and not in the conduit (300, 301). As discussed in relation to FIG. 2, a flow meter may be formed by placing an optical fiber 325 in any conduit 300 such that the energy from the decomposition of the reactant across the catalyst is traced in the optical fiber 325 as heat.

Furthermore, a gravel pack may be used in the well system of bore 335. The gravel pack may be created by the well known methods of pumping gravel. The gravel may be a gravel sized catalyst or a catalyst mixed with traditional gravel.

Similarly, a solid like sand, or in this case a catalyst (376, 377), may be blended into a slurry at the surface, pumped down a bore 335 of the well system through a crossover tool (not shown) such that the slurry circulates around the outer diameter of the sand screen 304 and the bore 335 of the well system. The fluid is then returned up the crossover tool (not shown) and bore 335 to the surface in a circulation such that the solid, in this case a catalyst 376, filters out on the outside of the sand screen 304 and in the formation 360. Then any one or all of the conduits (300, 301) may be used to inject a fluid, for example hydrogen peroxide, into the catalyst 376 disposed in the bore 335. The slurry can further be used to pump the catalyst 376 out into the formation 360 under hydraulic fracture pressures disposing the catalyst 377, as solids, into the fractures 303 as a proppant. The fluid, for example hydrogen peroxide, can also be pumped from an orifice 305 through the sand screen 304 and wire wrap mesh 306 out into the catalyst 377 in the fractures 303 to create energy.

The fluid may also be pumped into contact with the catalyst 375 disposed inside the sand screen 304 such that from time to time steam and/or heat can be generated from the catalytic reaction within the sand screen 304 to enhance cleaning of paraffin, scale, or other well residues from the sand screen 304, gravel pack, and reservoir 360. These escaping gases from the catalytic reaction in the sand screen 304 can also assist in lifting well system fluids to the surface, thereby enhancing the well system production while cleaning the well system for many years after the gravel pack completion has been deployed in the well system. This invention may aid in the mobilization of heavy oil reservoir fluids and lessen the need to go into gravel packed well systems to remedially clean them of scale, solids, and paraffin.

Figure 5:
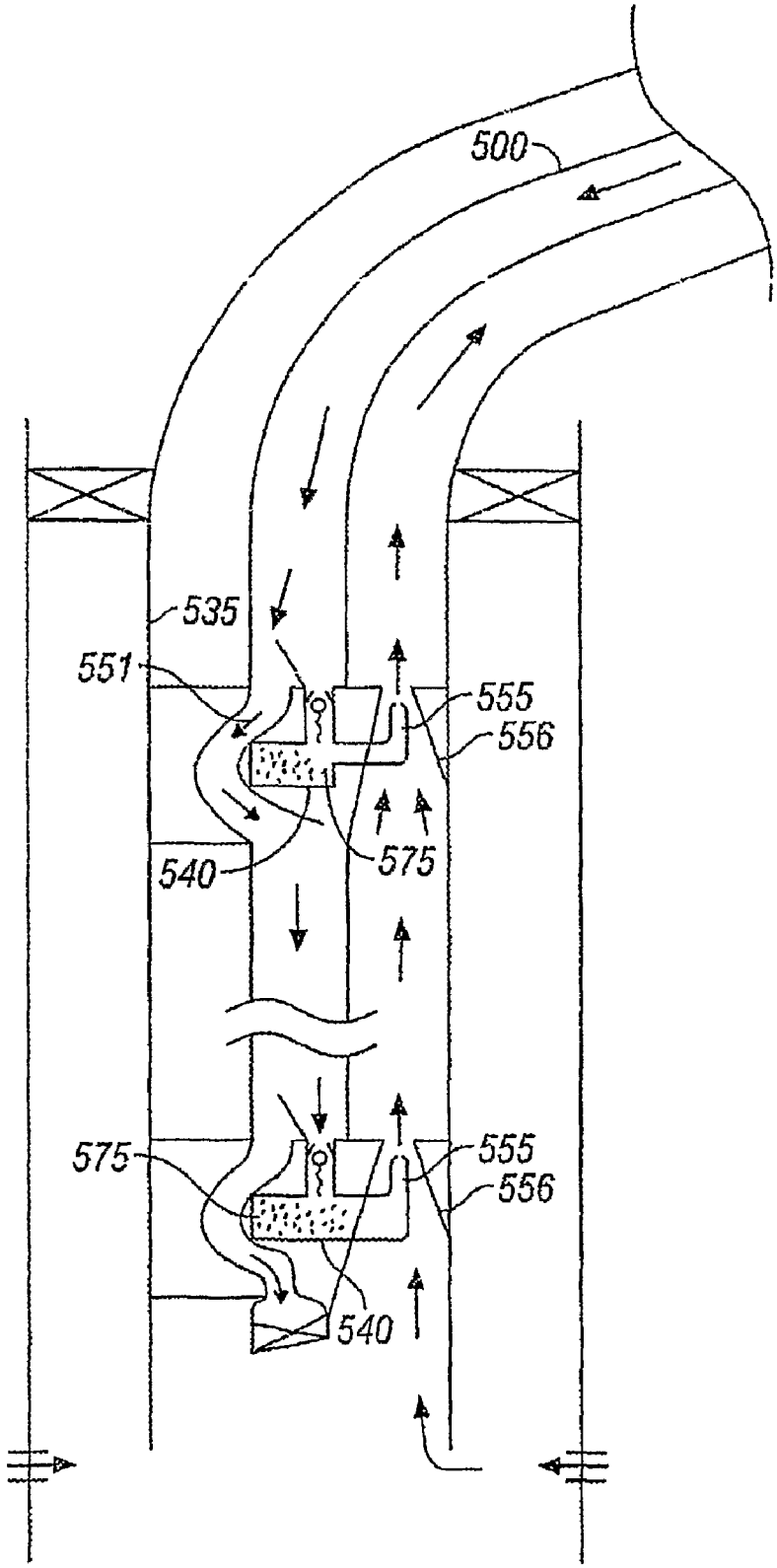
FIG. 5 is a schematic drawing of a conduit with multiple reaction chambers, fluid bypasses, and jet pumps attached thereto disposed in a well system, according to one embodiment of the invention.

Referring now to FIG. 5, a schematic view of another embodiment is shown. The conduit 500 and a plurality of reaction chambers 540 are disposed inside the bore 535 of a larger well system tubular. Here, the energy released by the reaction of the injected fluid and catalyst 575 is exhausted and returned to the surface from an exit port 555 through a venturi or jet pump 556. The jet pump 556 can aid the energy released to lift a solid and/or fluid to a surface location. A jet pump embodiment can be used to clean sand from a fracture job or unconsolidated sand from wells including horizontal wells as it robustly transduces solids as well as liquids. The jet pump embodiment can also be used to recover solids from great depths in well systems, such as in a riser extending from the sea floor. The venturi or jet pump 556 powered by the release of energy from the decomposition of the catalyst 575 and fluid may be replaced with a turbine or hydraulic motor, which may be at each reaction chamber, so that these machines extract work from the injected fluid and/or energy released from the catalytic decomposition of the fluid and any reaction thereafter of the reaction products with other fuels. The machines may be further used to power either a compressor or pump, allowing a reaction chamber's 540 energy to be converted into work and used to power down hole pumps and compressors, making this a multi-stage compressor or pump system without departing from the spirit of this invention.

Figure 6:
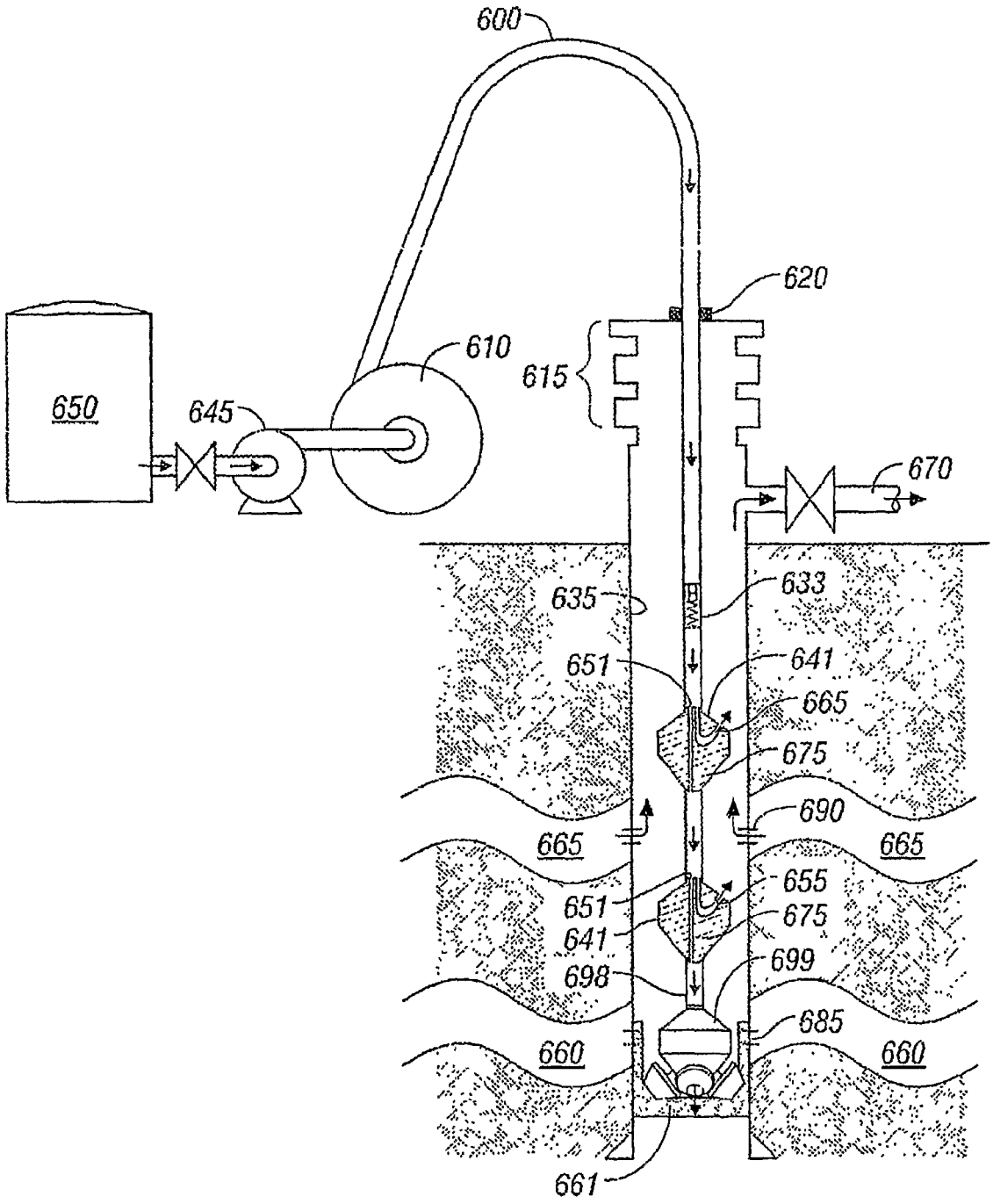
FIG. 6 is a schematic drawing of a conduit with multiple reaction chambers attached thereto and a turbine drill bit disposed in a well system, according to one embodiment of the invention.

FIG. 6 is another embodiment for using energy in a well system. Here a turbine drill bit 699 is disposed on a distal end of the conduit 600. The bore 635 of the well system may be, for example, casing. The well system contains a plug 661, which may be a drillable fracture, or frac, plug as known to those in the art.

The conduit 600 can be inserted from a reel 610 through well head devices 615 and a hydraulic seal 620 into the bore 635 of the well system. The turbine drill bit 699 is lowered into contact with the plug 661 via the conduit 600. A fluid can be injected from the tank 650 with a pump 645 and into the conduit 600. A single or plurality of reaction chambers 641 can be present. In the illustrated embodiment, the fluid passes a unidirectional fluid check valve 633 and may flow into a reaction chamber 641 and contact a catalyst 675, if present. The fluid may also flow down the conduit 600 via a bypass 651. The energy released by the fluid and catalyst reaction may be released from an orifice 655 on each reaction chamber 641 or released in the conduit 600 and into contact with the turbine drill bit 699. Both reaction chambers 641 illustrate that an orifice 655 may be oriented in any direction, here angled upward to provide additional thrust for the turbine drill bit. The reaction chamber orifices 655 are not required to be similarly oriented as shown.

Work can be extracted from the energy released from a reaction chamber 641 to drive the turbine drill bit 699 or other motor. Optionally a weight tube 698 may be added to aid in drilling and/or disposition of the turbine drill bit 699. The turbine drill bit 699 is shown after partially drilling the plug 661. This embodiment can also utilize the heat from the energy exhaust products of the reaction chamber 641 to reduce the resistance to drilling out items in the well system bore 635.

Similarly, energy released from an orifice 655 can aid the removal of solids generated by drilling to be lifted to a surface location. Additional energy may be added at various positions along the conduit 600 by including more reaction chambers 641. Multiple exhaust orifices 655 from the more than one reaction chamber 641 may be advantageous in horizontal wells and in drilling in under balanced conditions. When one stops pumping during those drilling conditions, solids can be deposited around the drilling tube, in this case the conduit 600, thereby causing the conduit to stick. This method of using various energy releasing orifices 655 to aid in the movement of fluids and solids can help reduce sticking.

The plug 661 may be drilled as discussed above or, if constructed so as to be meltable, removed by deforming the plug 661 or packer with energy. A plug 661 or packer may be a tin, brass, lead, or a plastic composite. The energy can be used to reduce the mechanical strength of drillable and/or retrievable devices for use in a well system bore 635 such as, but not limited to, plugs, packers, whipstocks, casing junctions, devices made with gas or fluid expansion chambers. Any of these well system devices may be constructed from metal, plastic, ceramic, or combinations thereof. The energy can be used to heat, melt, and/or expand well system devices, which may aid in retrieving or repositioning the devices in a well system bore 635.

The level of energy released, which may only be partially released from a reaction chamber housing the "released energy", is dependant on the decomposition of the fluid, which can be hydrogen peroxide, across a catalyst, and if any other fluids are added, a fuel for example. The energy can be released onto said plug 661 from an orifice (not shown) that is angled towards the plug 661 or no energy or decomposed fluid may be released from an orifice, but the heat from the energy may radiate through a reaction chamber 641 to melt or deform the plug 661. A plug 661 may be constructed with fluid encapsulation chamber in the plug 661 such that the heat developed by the catalytic reaction of this invention causes expansion in the plug 661 which may unset a mechanical device and/or cause the plug 661 to self destruct due to the expansion. The plug 661 may be suitable for use during the hydraulic fracturing of multiple (660, 665) zones. Each zone (660, 665) can be perforated (685, 690), fractured, and/or have a plug 661 set across the zone with this invention without departing from its spirit.

Figure 7:
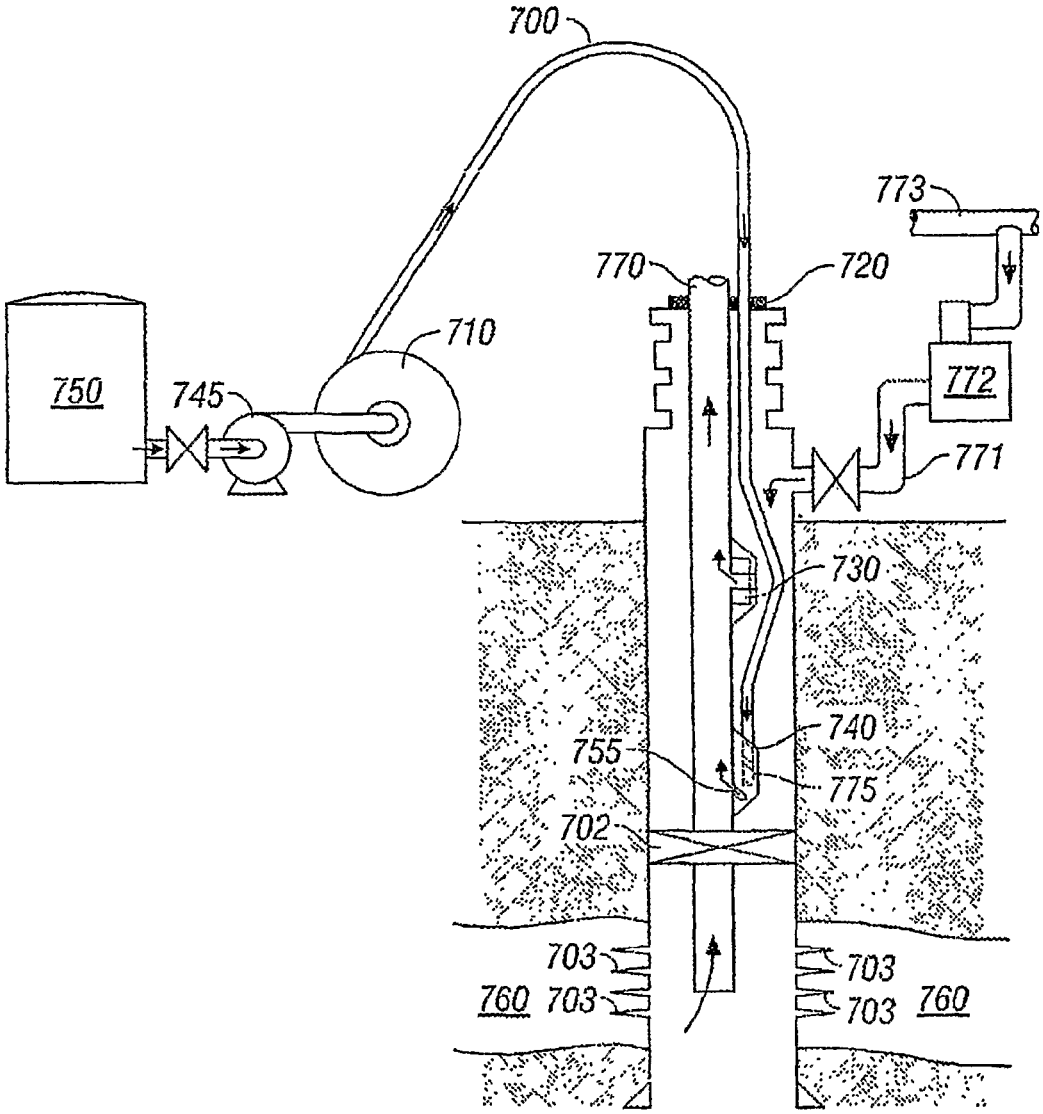
FIG. 7 is a schematic drawing of a conduit with a reaction chamber attached thereto disposed in a well system, according to one embodiment of the invention.

Energy can aid in the lifting of a formation or well fluid, for example a gas. FIG. 7 shows an embodiment of the invention whereby a fluid, for example hydrogen peroxide or a mixture thereof, can be injected from a tank 750 by a pump 745 through a reel 710 from which a length of conduit 700 extends. From the surface location, the conduit 700 enters a well system through well head devices 715 and into the bore 735 of the well system. The fluid is pumped into a reaction chamber 740 through an entry port. The aforementioned reaction chamber contains an exit port or orifice 755 attached to, and in fluid communication with, the inner bore of a length of production tubing 770. The reaction chamber 740 can be a side pocket mandrel. A catalyst 775 can be added to the reaction chamber 740 during insertion of the reaction chamber 740 or after attachment to the production tubing 770.

To use the embodiment shown, an optional gas lift or side pocket mandrel 730 may be present. If a gas lift mandrel 730 is present, a compressor 772 may be attached to a source of a gas 773 and injected into the well system bore 735 through a length of surface tubing 771. The gas is sealed from contacting a reservoir 760, shown with optional perforations 703, by a packer 702. The gas can be sealed from escaping the bore 735 by a hydraulic seal 720 on a proximal end of the well system and the packer 702, thus the only outlet being the gas lift mandrel 730. To aid in the lifting of a well system gas, the reactant fluid can be injected into the reaction chamber 740 into contact with a catalyst 775, with the released energy flowing into the production tubing 770 through an exit port or orifice 755. A plurality of reaction chambers 740 may be utilized. The energy can aid the movement of fluid upward though a jetting action and/or the decrease in density of the produced fluid when the reaction products are added. A catalyst 775 and/or reaction chamber 740 can be deployed into the gas lift mandrel 730 section of conduit 700 with standard wire line equipment or kick over tools. Although illustrated with a gas, the invention may be used with any fluid.

Figure 8:
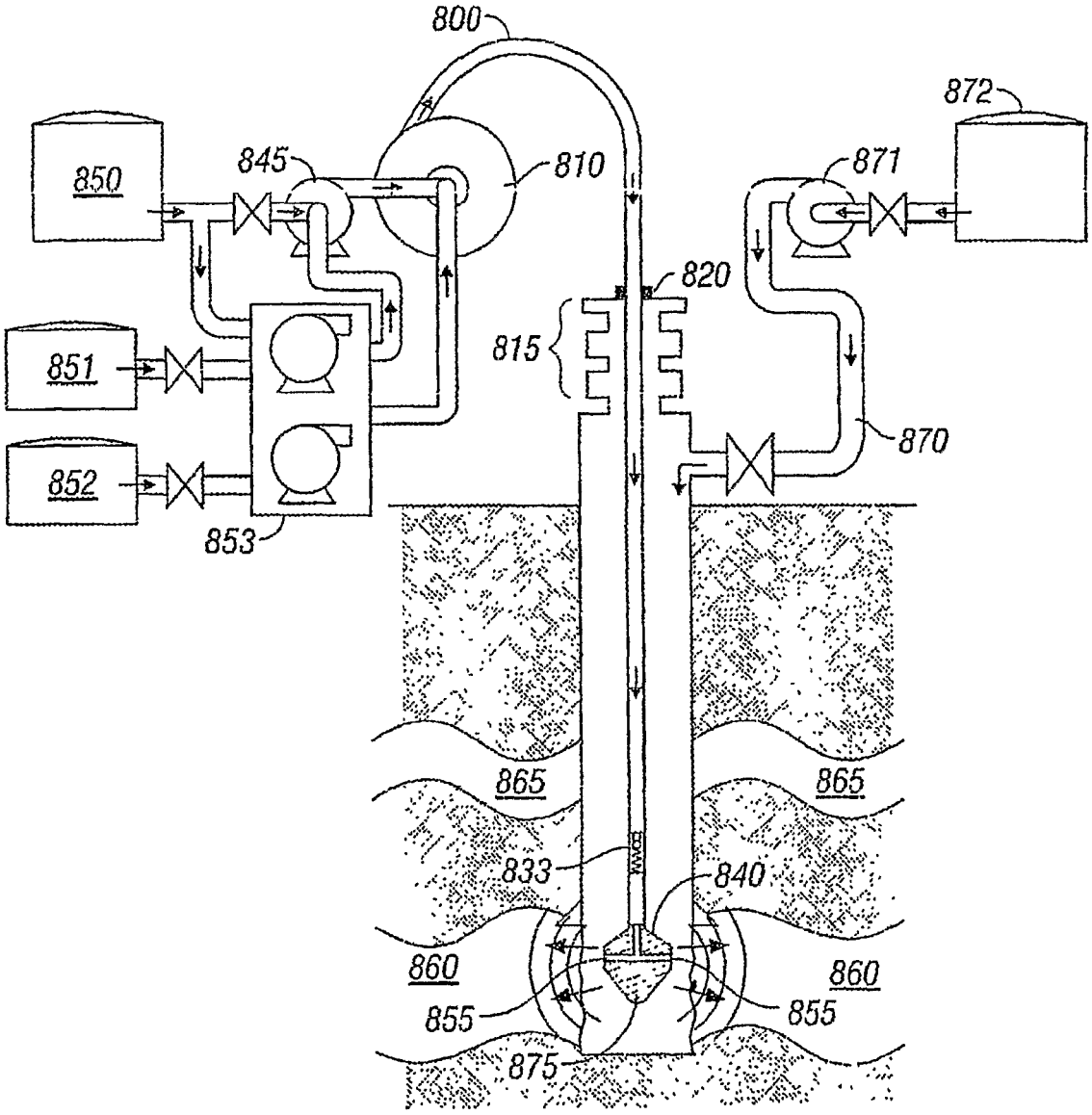
FIG. 8 is a schematic drawing of a proportioning apparatus and a conduit with a reaction chamber disposed adjacent an uncased section of a well system, according to one embodiment of the invention.

FIG. 8 illustrates another apparatus and method of the invention. Here, the energy can be used to heat, consolidate, or fuse a media or resin to the formation 860 to create a low permeability or impermeable barrier 861. The media can be a solid such as tin or lead, for example. Exothermic heat from the catalytic reaction can be utilized by moving the reaction chamber 840 adjacent a portion of unconsolidated bore and allowing the energy, which may or may not include releasing any fluids from an orifice 855, to exothermically melt and/or fuse reservoir 860 solids and/or fluids together. This can be achieved in an open hole section as shown in FIG. 8 or through a cased section of the well system, as in the section adjacent a second reservoir 865.

This invention's ability to control the down hole energy applied within a well system by changing the mixture of fluids and catalyst and/or moving the placement of the reaction chamber(s) allows for a plurality of fluids, solids, suspended solids in fluids to be injected into the reservoir and heated with this inventions down hole energy release methods yielding varying degrees of consolidation as a function of their melting and sublimation temperatures. The solids or suspended solids may be injected from a supply tank 872, through a pump 871 and into the bore 835 through a well system connection conduit 870.

As the invention allows the fluid, for example hydrogen peroxide, to be injected through a conduit 800 which can be located at any position in the well system while simultaneously moving the reaction chamber, or chambers, 840 connected thereto and releasing the energy from an orifice 855, large sections of the well system can be consolidated rapidly even in horizontal wells. The energy liberated by the methods of this invention is not restricted to flowing in hydraulic fluid pathways in the reservoir 860, often referred to as primary permeability. The liberated energy generated by this invention can radiate and be conducted in a homogenous front proceeding from the well system bore 835 outward. The conduit 800 can be moved, for example up and down within the well system bore 835, at any step of the process or any time period.

The energy can be used to reduce or remove a reservoir's capacity to flow fluid by heating the reservoir and/or any injected fluid and solids artificially placed in and/or naturally occurring in said reservoir 860. For example, drilling fluid or "mud" can have media in it that can form a wall cake 861 depending on the permeability and porosity of the formation in the well system. This wall cake 861 can be formed with materials that can be hardened and baked with the energy released by this invention's methods, thus forming a ceramic or impermeable well bore that restricts fluid flow. A wall cake 861 can be formed by using a catalyst 875 that reacts with a fluid, for example hydrogen peroxide, to cause energy to be released from the decomposition of the reactant. The energy can be used to cause materials, either natural or artificially placed in the reservoir, to reduce the permeability of the reservoir 860 and/or consolidate the reservoir. Furthermore, if the artificially placed media can be melted, like tin or lead, it can be used to form a consolidation or cementation effect on the reservoir once the material cools down after being melted by the exothermic heat release. Reducing a reservoir's 860 ability to conduct fluids to the bore 835 may be desirable to those skilled in the art. Reduced permeability can be used to seal off unwanted water encroachment, form barriers in the bottom of hydrocarbon barriers, seal of gas cap encroachment in a oil reservoir, or facilitate the placement of what is know as "frac pack" treatments. Similarly, a non-permeable and permanent hydraulic seal can be formed on the wall of the uncased portion of the well system bore 835 by applying energy from the reaction chamber 840, and then fracturing the impermeable area with a sand laden fluid creating a fluid path to the reservoir 860 through the impermeable skin placed along the bore such that the sand in the hydraulically created fracture serves the purpose of filtering out sand and/or solids that may move with reservoir fluids as the well system is produced into the bore 835.

The capability of the invention to control the down hole energy released within the well system by changing the mixture of at least one fluid and/or catalyst and/or moving the placement of the reaction chamber(s) allows for a plurality of fluids, solids, and/or solids suspended in fluids to be injected into the reservoir and heated with this inventions down hole energy release methods yielding varying degrees of consolidation as a function of their melting and sublimation temperatures. The solids or suspended solids may be injected from a supply tank 872, through a pump 871 and into the bore 835 through a well system connection conduit 870 or any other means known in the art.

FIG. 8 illustrates one method of changing the ratio of a mixture of fluids (850, 851, 852) and/or a catalyst. A catalyst 875 is shown predisposed in the reaction chamber 840, but is not so required, and may be injected. The ratio change, or mixing, can occur at a surface location or down hole. Although the injected mixture can include a catalyst, a fluid, for example hydrogen peroxide or other reactant fluid, can be injected through a conduit (not shown) disposed within the well system and into contact with a naturally occurring catalyst (not shown) without departing from the spirit of the invention. The invention does not require the step of artificially depositing the catalyst in the well system or reaction chamber 840. For example, a well system may include naturally occurring oxides or metal impurities such as hematite and bauxite that may react with the fluid, for example hydrogen peroxide, to release energy.

A proportioning apparatus 853 can be connected to at least one pump 845 and tank (850, 851, 852). The proportioning apparatus 853 may include a valve or a pump and may be manually or electrically operated. Although three tanks (850-852) are shown, the invention is not so limited and can be a single tank or other type of fluid supply. The proportioning apparatus 853 may be directly connected to the pump 845 and/or reel 810 in fluid combination with the conduit 800. The proportioning apparatus 853 can allow any mixture of fluid, solid, and/or catalyst to be provided for injection into the conduit 800 or well system bore 835. The schematic details in the drawing and text of how the individual components are connected are for illustrative purposes only. Any mixing means can be used to create a mixture of fluids and/or catalyst and/or fuel for injection into the well system and/or reaction chamber 840. The injection can occur through more than one conduit. The mixing step can occur in the reaction chamber 840.

The mixture, and thus the energy released from the catalytic reaction, can be controlled from a surface location by changing the percentage of a first fluid, for example hydrogen peroxide, from a first tank 850 and a second fluid, for example water, from a second tank 851 through the proportioning apparatus 853. The amount of energy released during the catalytic reaction can also be modified by adding different percentages of fuel, for example methanol, from a third tank 852 and/or catalyst at a surface location by blending them into the mixture to be injected through the conduit 800. As discussed above, a solid or suspended solid or other media may be injected from a supply tank 872, through a pump 871 and into the bore 835 through a well system connection conduit 870. However, a solid, for example an abrasive solid, can also be added to the mixture via the proportioning apparatus 853 to give the energy exhausted down hole from an orifice 855 the ability to cut, jet, and/or drill the well system bore 835 or items in the well system. This may includes perforating the casing and/or formation with this energy and abrasive mixture. The abrasive can be sand or garnet, for example. Abrasive material may be added down a second conduit (not shown) and mixed at the exit port of a reaction chamber with the released energy that is selectively released.

Although the proportioning apparatus 853 is described in reference to FIG. 8, it can be used with any embodiment herein without departing from the spirit of the invention, for example with the catalyst used as a proppant.

Figure 9:
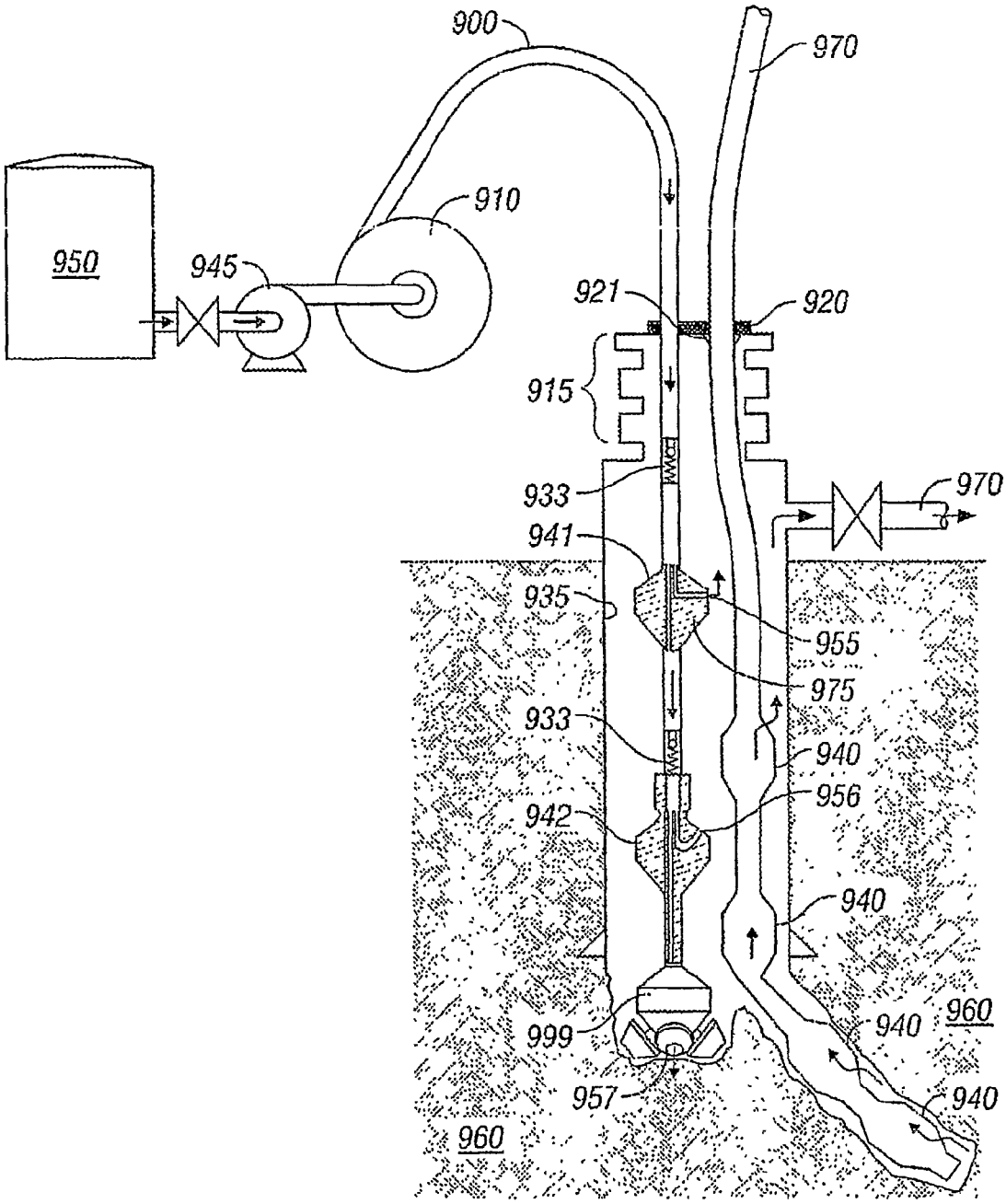
FIG. 9 is a schematic drawing of two conduits with multiple reaction chambers attached thereto disposed in a well system, according to one embodiment of the invention.

FIG. 9 discloses another apparatus and method for selectively releasing energy in a well system. A first conduit 970 is shown disposed with the bore 935 of the well system and extending into the reservoir 960 from a tubing hanger 921 adjacent the well head devices 915, which can for example include a blow out preventor or annular ram. The first conduit 970 has reaction chambers 940 which are shown absent a catalyst. Although no orifices are shown, they have formerly been present but now closed. A conduit 970, which may have been previously used to release energy in a well system, may be used as a production conduit.

The second conduit 900 is shown attached to a reel 910 providing fluid communication with a pump 945 in fluid communication with a tank 950, which can contain hydrogen peroxide, for example. The second conduit 900 is shown including optional unidirectional fluid check valves 933 and sealed to the well system with hydraulic seal 920.

In use, the fluid, for example hydrogen peroxide, is injected past a unidirectional fluid check valve 933 and into contact with a catalyst 975 which may be present in a reaction chamber (941, 942). The fluid may then be used to power a turbine drill bit 999 on a distal end of the second conduit 900. The fluid may react with the catalyst 975, if present, to release energy. The "released energy" may be released from the first reaction chamber 941 out of an orifice 955 on the first reaction chamber 941. The energy and/or fluid may be further injected into the second reaction chamber 942 where additional energy may be released from a second catalyst 975 and fluid reaction. The energy may be released from a reverse thrust jet 956, as shown on the second reaction chamber 942, to aid in the drilling by creating additional downward force. A portion or all of the energy may be released into the turbine drill bit 999 to provide power to drill the reservoir 960. A portion of energy may be released from a downward facing jet 957 on a distal end of the conduit 900 to drill a formation, as is known to those skilled in the art. This method fluidizes the surrounding earth with the downward facing jet 957. The conduit 900 can then become casing, and production can be achieved by cutting the conduit 900 at the surface, hanging it from a well head device 915, and producing therethrough. The energy may further aid in the production of formation or well fluids from surface tubing 970 by adding energy to a fluid in the well system bore 935.

Figure 10:
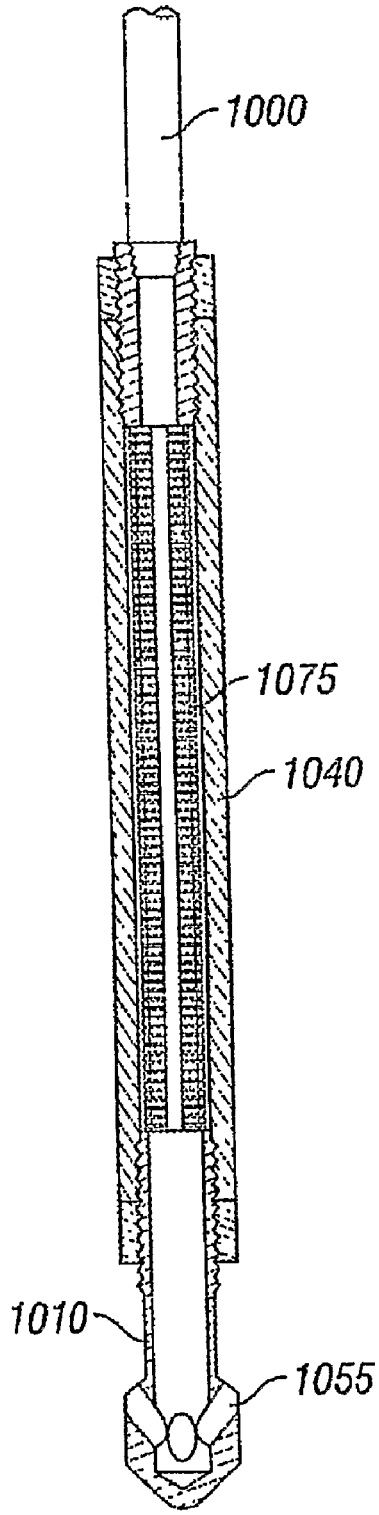
FIG. 10 is a schematic drawing of a reaction chamber with a catalyst present, according to one embodiment of the invention.

FIG. 10 is another embodiment of a reaction chamber 1040, shown threadably connected at a proximal end to a conduit 1000 which may be coiled tubing, for example. A catalyst 1075 is shown disposed in the bore of the reaction chamber 1040. The distal end of the reaction chamber 1040 is shown threadably engaged to an optional sub 1010. The sub 1010 contains a reverse thrust jet 1055, but the sub may include any orifice or jet as desired, or no orifice or jet. The entire assembly may also be referred to as a reaction chamber.

Figure 11:
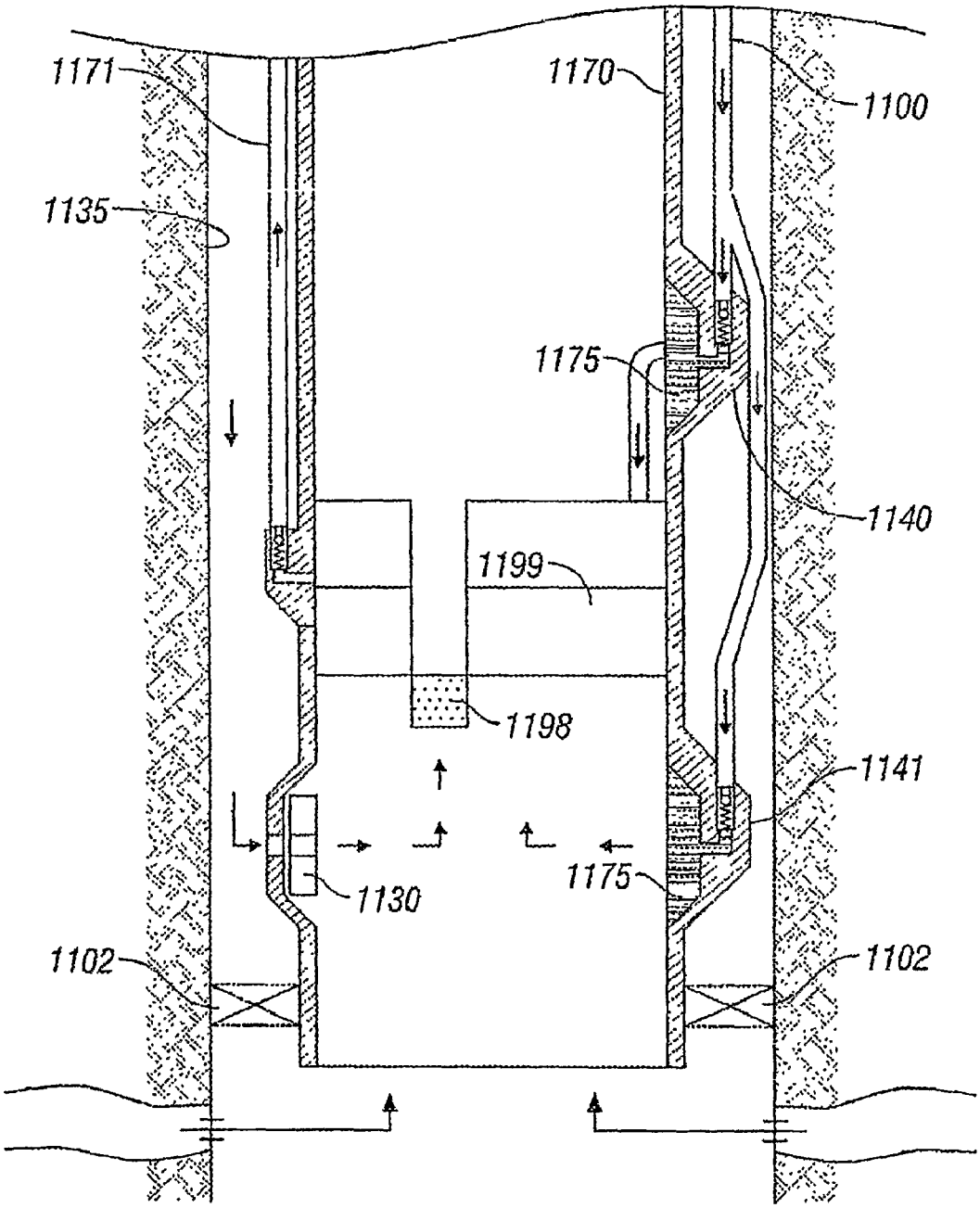
FIG. 11 is a schematic drawing of a conduit with two reaction chamber attached thereto disposed in a well system, according to one embodiment of the invention.

FIG. 11 discloses another apparatus and method for selectively releasing energy in a well system. Multiple reaction chambers (1140, 1141) are shown with a catalyst 1175 disposed in each. A conduit 1100 is provided for injecting a reactant fluid into each reaction chamber (1140, 1141). Although not shown, each reaction chamber (1140, 1141) can have its own fluid supply conduit 1100. The reaction chambers (1140, 1141) are disposed in side pocket mandrels of a second conduit 1170. The second conduit 1170 is sealed to the bore 1135 of a well system by a packer 1102. A fluid transducer 1199 is shown disposed in the bore of the second conduit 1170 with a turbine exhaust conduit 1171 extending into the well system bore 1135 and to a surface location. The fluid transducer 1199 may be a turbine pump or compressor which is powered by the first reaction chamber 1140 with the exhaust released from the exhaust conduit 1171 (shown) or into the bore of the second conduit 1170 to aid in lifting any fluid therein.

To use, a gas may be injected through the gas lift valve 1130 from the bore 1135 of the well system and into the bore of the second conduit 1170. A reactant fluid may be pumped into either or both reaction chambers (1140, 1141) and into contact with the catalyst 1175. The energy released from the catalytic reaction in the second reaction chamber can be selectively released into the bore of the second conduit 1170 to produce lift. If present, a turbine fluid transducer 1199 can be powered by selectively releasing the released energy from the first reaction chamber 1140 to power the turbine. The turbine can then pull a fluid through an intake port 1198 and up the bore of the second conduit 1170 to aid the lifting of any fluid in the bore, for example a hydrocarbon. A reaction chamber 1140 can be disposed into an existing side pocket mandrel of the second conduit 1170 from the surface as is known in the art. The reaction chamber 1140 can allow for connection with a first conduit 1100 extending to the surface during the disposition step. A reaction chamber may be removed when desired. This may include retrieving a reaction chamber 1140 from the bore of the second conduit 1170 by disposing a side pocket kick over into the side pocket mandrel, latching to a fishing neck (not shown) on the reaction chamber 1140, jarring the reaction chamber 1140 from the side pocket mandrel, and removing the reaction chamber from the bore 1135 of the well system.

Although the reaction chamber is shown in each of the figures with a larger external diameter than the internal diameter of the conduit, the invention is not so limited. The reaction chamber can be sized so as to be removable from inside the conduit, for example from the surface with a fishing tool, without removing the conduit from a well system. A fishing tool may also be used to close an orifice on the conduit, for example to use the conduit as production tubing. Some orifices may be left open adjacent a reservoir to allow production therethrough. A reaction chamber may also be drilled out from a surface location by a drill bit disposed in the conduit. A reaction chamber can be used on any conduit, for example drill pipe.

Many other applications may be suggested which use the heat and/or energy associated with the chemical reaction described herein without departing from the spirit or intent of this disclosure. While the invention has been described with respect to a limited number of embodiments, those skilled in the art will appreciate numerous modifications and variations therefrom. It is intended that the appended claims cover all such modifications and variations as fall within the true spirit and scope of the invention.

I claim:

1. An apparatus comprising:

a conduit having a surface connection on a proximal end and at least one reaction chamber on a distal portion of said conduit, said conduit disposed in a well system;

a sensor located on said conduit between a distal end and the proximal end;

a source of a peroxide coupled to said conduit and said reaction chamber;

a data line extending from said sensor to the surface connection;

a catalyst disposed within the reaction chamber; and at least one energy focusing orifice, said energy focusing orifice providing an outlet for the reaction chamber.

2. The apparatus of claim 1 wherein the catalyst is disposed within said reaction chamber after said conduit is disposed in the well system.

3. The apparatus of claim 1 wherein the catalyst is disposed within said reaction chamber before said conduit is disposed in the well system.

4. The apparatus of claim 1 wherein the reaction chamber further comprises at least one bypass allowing a fluid to flow through the conduit without contacting the catalyst in a reaction chamber.

5. The apparatus of claim 1 wherein the reaction chamber is disposed in a side pocket mandrel.

6. The apparatus of claim 5 wherein at least one side pocket mandrel is connected to a second conduit extending to a surface location.

7. The apparatus of claim 1 further comprising a second conduit connected between the surface connection and the reaction chamber.

8. The apparatus of claim 1 wherein the conduit is disposed inside a larger diameter second conduit.

9. The apparatus of claim 1 wherein the sensor is disposed within the conduit.

10. The apparatus of claim 1 wherein the conduit comprises a continuous tube.

11. The apparatus of claim 1 wherein the conduit comprises stainless steel.

12. The apparatus of claim 1 wherein the conduit comprises at least 50% nickel.

13. The apparatus of claim 1 wherein the conduit comprises a cold worked tube.

14. The apparatus of claim 1 further comprising at least one unidirectional fluid check valve disposed within said conduit.

15. The apparatus of claim 1 wherein an outer surface of the conduit includes at least one orifice in fluid communication with a bore of the conduit.

16. The apparatus of claim 1 said peroxide is hydrogen peroxide.

17. The apparatus of claim 1 further comprising a source of fuel coupled to said reaction chamber.

18. The apparatus of claim 17 wherein the fuel comprises methanol.

19. The apparatus of claim 17 wherein the fuel comprises diesel.

20. The apparatus of claim 17 wherein the fuel comprises methane.

21. The apparatus of claim 17 wherein the fuel comprises oil.

22. The apparatus of claim 17 wherein the fuel comprises sugar.

23. The apparatus of claim 1 further comprising at least one abrasive solid source in fluid communication with the conduit.

24. The apparatus of claim 1 further comprising at least one fuel inlet port on the reaction chamber.

25. The apparatus of claim 1 further comprising at least one electrical conductor wire line sensor attached to the conduit.

26. The apparatus of claim 25 wherein the at least one electrical wire line sensor is a gamma ray recorder.

27. The apparatus of claim 25 wherein the at least one electrical wire line sensor is a casing collar locator.

28. The apparatus of claim 25 wherein the at least one electrical wire line sensor is a density neutron tool.

29. The apparatus of claim 1 further comprising at least one electrical conductor disposed within the conduit.

30. The apparatus of claim 29 further comprising at least one ignition source connected to the electrical conductor.

31. The apparatus of claim 1 further comprising at least one optical fiber disposed within the conduit.

32. The apparatus of claim 31 further comprising an optical time domain reflectometry device providing a light source to the optical fiber and interrogating a backscattered light parameter with the optical fiber for distributive temperature monitoring at a surface location.

33. An apparatus comprising:

a conduit disposed in a well system, said conduit having a surface connection on a proximal end and at least one reaction chamber on a distal portion;

a sensor located on the conduit between a distal and proximal ends;

a source of a peroxide coupled to said conduit and said reaction chamber;

a data line extending from said sensor to the surface connection; and a proportioning apparatus in fluid communication with said conduit; and at least one jet disposed on an outer surface of the reaction chamber and in fluid communication therewith.

34. The apparatus of claim 33 further comprising a catalyst disposed in the reaction chamber.

35. The apparatus of claim 33 further comprising a catalyst tank in fluid communication with the proportioning apparatus.

36. The apparatus of claim 33 further comprising a fuel tank in fluid communication with the proportioning apparatus.

37. The apparatus of claim 33 further comprising a water tank in fluid communication with the proportioning apparatus.

38. The apparatus of claim 33 wherein the at least one jet is disposed adjacent a well system.

39. A method for selectively releasing energy in a well system comprising:

disposing a conduit within the well system, said conduit having at least one reaction chamber on a distal portion;

injecting a fluid from a surface location through the conduit and into contact with a catalyst disposed in the reaction chamber, said catalyst reacting with the fluid to release energy, said fluid comprising a peroxide; and selectively releasing at least a portion of the released energy from the reaction chamber with at least one orifice.

40. The method of claim 39 wherein the fluid is an oxidant.

41. The method of claim 39 wherein the fluid comprises hydrogen peroxide.

42. The method of claim 39 where the fluid is a blend of at least two fluids, wherein at least one of the fluids reacts and decomposes over the catalyst and at least one of the other fluids reacts with a product formed by the catalytic decomposition of the first fluid.

43. The method of claim 39 further comprising injecting a fuel into the reaction chamber through the conduit.

44. The method of claim 39 further comprising injecting a fuel into the reaction chamber through a second conduit disposed within the well system and extending from the surface location.

45. The method of claim 43 or 44 wherein the fuel comprises methanol.

46. The method of claim 43 or 44 wherein the fuel comprises diesel.

47. The method of claim 43 or 44 wherein the fuel comprises methane.

48. The method of claim 43 or 44 wherein the fuel comprises oil.

49. The method of claim 43 or 44 wherein the fuel comprises sugar.

50. The method of claim 39 further comprising providing at least one unidirectional fluid check valve within the conduit between the reaction chamber and the surface location.

51. The method of claim 39 further comprising disposing an electrical conductor within the conduit, said electrical conductor extending from the surface location to a sensor attached to the conduit.

52. The method of claim 39 further comprising deploying at least one optical fiber within the well system.

53. The method of claim 52 further comprising creating with optical time domain reflectometry a temperature profile along a length of the well system using a distributed temperature survey device and the optical fiber.

54. The method of claim 53 further comprising determining a depth of the conduit by correlating a previously run electrical log showing well depth and temperature to said temperature profile of the well system.

55. The method of claim 53 further comprising:

releasing a portion of the released energy from the reaction chamber into a fluid stream flowing in the well system to heat said stream;

tracking a velocity of the energized well fluid using the temperature profile; and estimating a fluid flow measurement in the well system by using the fluid velocity and a known volume of the well system.

56. The method of claim 39 further comprising selectively releasing the released energy on a turbine, said turbine powering at least one stage of a pump.

57. The method of claim 39 further comprising selectively releasing the released energy on a turbine, said turbine powering at least one stage of a compressor.

58. The method of claim 39 further comprising using the released energy to power a work extraction device disposed in the well system.

59. The method of claim 39 further comprising heating a second fluid present in the bore of the well system with a portion of the released energy.

60. The method of claim 59 wherein the second fluid is a well fluid.

61. The method of claim 59 wherein the second fluid is a drilling fluid.

62. The method of claim 59 wherein the second fluid is a stimulation fluid.

63. The method of claim 39 further comprising drilling a plug disposed within the well system with a turbine drill bit disposed on a distal end of the conduit, said turbine drill bit at least partially powered by a portion of the released energy.

64. The method of claim 39 further comprising displacing the conduit in the well system while selectively releasing the released energy.

65. The method of claim 39 further comprising:

disposing an optical fiber within the well system;

providing an optical time domain reflectometry device at a surface location, said optical time domain reflectometry device providing a light source to the optical fiber; and interrogating and recording a backscattered light parameter with the optical fiber in a time domain to create a temperature profile along a length of the optical fiber with the optical time domain reflectometry device.

66. The method of claim 39 further comprising forming a weldment with the released energy contained in the reaction chamber.

67. The method of claim 39 further comprising adding an abrasive material to the fluid.

68. The method of claim 39 further comprising injecting a recovery fluid from the surface location through the conduit into contact with the catalyst, said recovery fluid recovering at least a portion of the catalyst's catalytic characteristics.

69. The method of claim 68 wherein the recovery fluid is an acid.

70. A method for selectively releasing energy in a well system comprising:

disposing a conduit with at least one reaction chamber connected thereto into the well system through a dynamic hydraulic packoff on a proximal end of the well system;

measuring a well characteristic with at least one sensor attached to the conduit;

measuring a position of a portion of the conduit in the well system;

correlating the position of the portion of the conduit with a location of interest in the well system;

connecting the conduit at a surface location to at least one pump; connecting the pump to a fluid reservoir; and pumping the fluid through the conduit and into an entry port on at least one of the reaction chambers, said fluid reacting with a catalyst in the reaction chamber to release energy in the reaction chamber, said fluid comprising a peroxide.

71. The method of claim 70 wherein the fluid comprises hydrogen peroxide.

72. The method of claim 70 further comprising pumping a fuel into the reaction chamber from the surface location.

73. The method of claim 70 further comprising selectively releasing at least a portion of the released energy from at least one orifice on said reaction chamber.

74. The method of claim 70 further comprising disposing at least one of the orifices adjacent a location of interest in the well system and selectively releasing at least a portion of the released energy.

75. The method of claim 74 further comprising disposing at least one of the orifices adjacent a second location of interest in the well system and selectively releasing a second portion of the released energy.

76. The method of claim 74 wherein an adjacent surface of the well system is perforated with the portion of the released energy.

77. A method for selectively releasing energy in a well system comprising:

disposing a conduit with a plurality of reaction chambers disposed therein within the well system, at least one of the reaction chambers including an entry port in fluid communication with the conduit and an exit port in fluid communication with a bore of the well system;

injecting a fluid from a surface location through the conduit and into contact with a catalyst disposed in at least one of the reaction chambers, said catalyst reacting with the fluid to release energy, said fluid comprising a peroxide; and selectively releasing at least a portion of the released energy from at least one of the exit ports.

78. The method of claim 77 wherein the conduit further comprises at least one unidirectional fluid check valve in the conduit between the entry port on one of the reaction chambers and the surface location.

79. The method of claim 77 wherein the fluid comprises hydrogen peroxide.

80. The method of claim 77 further comprising lifting a well fluid within the bore of the well system with the portion of selectively released energy.

81. The method of claim 77 further comprising cleaning a section of the bore of the well system with the portion of selectively released energy.

82. The method of claim 77 further comprising correlating the depth of at least one reaction chamber with a location of interest in the well system.

83. The method of claim 77 wherein at least one of the reaction chambers further comprises a jet pump in fluid communication with the exit port.

84. A method for selectively releasing energy in a well system comprising:

providing a well system including a section of a formation in fluid communication with the well system;

disposing a catalyst in the well system;

propping open at least a portion of a formation with said catalyst; and injecting a fluid from a surface location through a conduit into the portion of the formation, said catalyst reacting with the fluid to release energy, said fluid comprising a peroxide.

85. The method of claim 84 wherein the fluid comprises hydrogen peroxide.

86. The method of claim 84 further comprising heating a portion of the formation with the released energy.

87. A method for selectively releasing energy in a well system comprising:

disposing a first conduit with a reaction chamber attached thereto within the well system, said reaction chamber including an entry port in fluid communication with a second conduit extending from a surface location and an exit port in fluid communication with a bore of the first conduit;

injecting a fluid through the second conduit and into contact with a catalyst disposed in the reaction chamber, said catalyst reacting with the fluid to release energy, said fluid comprising a peroxide; and selectively releasing at least a portion of the released energy from the exit port into the bore of the first conduit.

88. The method of claim 87 wherein the first conduit further comprises a plurality of reaction chambers attached thereto.

89. The method of claim 87 further comprising lifting a well fluid within the bore of the first conduit with a portion of the selectively released energy.

90. A method for selectively releasing energy in a well system comprising:

injecting a media into the well system;

disposing at least one reaction chamber on a distal portion of a conduit into the well system adjacent a location of interest in a formation;

injecting a fluid from a surface location through the conduit and into contact with a catalyst disposed in at least one of the reaction chambers, said catalyst reacting with the fluid to release energy, said fluid comprising a peroxide;

selectively releasing at least a portion of the released energy from an exit port on the reaction chamber at the location of interest in the formation; and fusing the media to the location of interest with the released energy.

91. The method of claim 90 further comprising disposing the reaction chamber adjacent a second location of interest in the formation and fusing the media to the second location of interest by selectively releasing a second portion of the released energy.

92. A method for selectively releasing energy in a well system comprising:

disposing a conduit within the well system, said conduit having a reaction chamber disposed on a distal portion thereof;

injecting a fluid from a surface location through the conduit and into contact with a catalyst disposed in the reaction chamber, said catalyst reacting with the fluid to release energy, said fluid comprising a peroxide; and drilling a formation by selectively releasing at least a portion of the released energy from the reaction chamber through a downward facing jet attached to and in fluid communication with the reaction chamber as the conduit is downwardly displaced.

93. The method of claim 92 further comprising producing a fluid from the formation through said conduit after drilling.

94. The method of claim 92 further comprising releasing a second portion of the released energy from a reverse thrust jet mounted on said conduit during drilling.

95. The method of claim 92 further comprising lifting a well fluid within a bore of the well system with a portion of the energy selectively released from an exit port of a second reaction chamber disposed on said conduit, said second reaction chamber having an entry port in fluid communication with said conduit and an exit port in fluid communication with the bore of the well system.

96. The method of claim 95 wherein said conduit further comprises at least one unidirectional fluid check valve disposed therein between the surface location and the entry port.

97. The method of claim 92 further comprising repeating the disposing, injection, and drilling steps with a second conduit containing a downward facing jet.

98. A method for selectively releasing energy in a well system comprising:

providing a conduit having a reaction chamber disposed on a distal portion;

injecting a fluid from a surface location through the conduit and into contact with a catalyst disposed in the reaction chamber, said catalyst reacting with the fluid to release energy, said fluid comprising a peroxide;

disposing the reaction chamber adjacent a plug previously disposed within the well system; and heating the plug with the released energy to deform said plug.

99. The method of claim 98 wherein the heating is radiant heating.

100. The method of claim 98 wherein the plug comprises lead.

101. The method of claim 98 wherein the plug comprises brass.

102. The method of claim 98 wherein the plug comprises tin.

103. The method of claim 98 wherein the plug comprises a chamber containing a second fluid that expands when exposed to a level of energy to deform said plug.

104. A method for selectively releasing energy in a well system comprising:

disposing a conduit within the well system, said conduit having a reaction chamber on a distal portion;

connecting a proportioning apparatus to a source of a fuel, a source of a fluid, said fluid comprising a peroxide, and a proximal end of the conduit;

injecting a mixture of the fuel and fluid through the conduit and into contact with a catalyst disposed in the reaction chamber, said catalyst reacting with the mixture to release energy; and selectively releasing at least a portion of the released energy from at least one orifice in fluid communication with the reaction chamber.

105. A method for selectively releasing energy in a well system comprising:

disposing a conduit within the well system, said conduit having a reaction chamber disposed on a distal portion;

connecting a proportioning apparatus to a source of a catalyst, a source of a fluid, said fluid comprising a peroxide, and a proximal end of the conduit;

injecting a mixture of the fluid and catalyst through the conduit and into the reaction chamber, said catalyst reacting with the fluid to release energy; and selectively releasing at least a portion of the released energy from at least one orifice in fluid communication with the reaction chamber.

106. The method of claim 105 further comprising varying a ratio of the fluid and catalyst mixture with the proportioning apparatus.

107. The method of claim 105 further comprising connecting the proportioning apparatus to a source of a fuel and injecting a mixture of the fluid, catalyst, and fuel into the reaction chamber.

108. The method of claim 107 further comprising varying a ratio of the fluid, catalyst, and fuel mixture with the proportioning apparatus.

109. A method as in any one of claims 104-108 wherein the fluid comprises hydrogen peroxide.

110. An apparatus comprising:

a continuous conduit with a reaction chamber attached to a distal portion and a proximal end attached to a reel by a hydraulic swivel at a surface location, said continuous conduit disposed in a well bore and having at least one unidirectional fluid check valve disposed therein and said hydraulic swivel in fluid communication with the continuous conduit;

an injector head removably sealing the continuous conduit to a well system during conduit displacement without pressure loss in the well system, said well system comprising a hydraulic pack off removably sealing an outer diameter of the continuous conduit to the well bore, a lubricator sealingly engaged to a blow out preventer, said blow out preventer sealingly engaged to a well head, said well head sealingly engaged to the well bore;

a pump in fluid communication with said continuous conduit;

said pump connected to a fluid tank, said fluid tank having a fluid comprising a peroxide;

a data transmission, receiving, and collection apparatus;

at least one sensor attached to the continuous conduit; and a data transmission line disposed in the continuous conduit and connected to said sensor and said data transmission, receiving, and collection apparatus.

111. A method for selectively releasing energy in a well system comprising:

disposing a conduit within the well system, said conduit having a reaction chamber on a distal portion; and injecting a fluid comprising a peroxide from a surface location through the conduit and into contact with a catalyst naturally occurring in the well system, said catalyst reacting with the fluid to release energy.

112. A method for selectively releasing energy in a well system comprising:

disposing in the well system a conduit having a surface connection on a proximal end and a sand screen disposed on a distal portion, said sand screen at least partially constructed of a catalyst; and injecting a fluid comprising a peroxide from a surface location through the conduit and into contact with the catalyst, said catalyst reacting with the fluid to release energy.

113. A method for selectively releasing energy in a well system comprising:

disposing in the well system a conduit having a surface connection on a proximal end, a sand screen disposed on a distal portion, and a catalyst disposed between an outer diameter of the conduit and an inner diameter of the sand screen; and injecting a fluid comprising a peroxide from a surface location through the conduit and into contact with the catalyst, said catalyst reacting with the fluid to release energy.

114. A method for selectively releasing energy in a well system comprising:

disposing in the well system a conduit having a surface connection on a proximal end and a sand screen disposed on a distal end;

disposing a gravel pack between an outer diameter of the sand screen and an inner diameter of the well system, said gravel pack including a catalyst; and injecting a fluid comprising a peroxide from a surface location through the conduit and into contact with the catalyst, said catalyst reacting with the fluid to release energy.

115. A method as in any one of claim 111, 112, 113, or 114 wherein the fluid is a mixture of fluids from a proportioning apparatus.

116. An apparatus comprising:

a conduit disposed in a well system having a surface connection on a proximal end and a sand screen disposed on a distal portion, said sand screen at least partially constructed of a catalyst, said conduit coupled to a source of a fluid comprising a peroxide;

a sensor located on said conduit between said proximal and a distal ends; and a data line extending from said sensor to the surface connection.

117. An apparatus comprising:

a conduit disposed in a well system having a surface connection on a proximal end and a sand screen disposed on a distal end, said conduit coupled to a source of a fluid comprising a peroxide;

a catalyst disposed between an outer diameter of the conduit and an inner diameter of the sand screen;

a sensor located on said conduit between said proximal and said distal ends; and a data line extending from said sensor to the surface connection.

118. An apparatus comprising:

a conduit disposed in a well system having a surface connection on a proximal end and a sand screen disposed on a distal end, said conduit coupled to a source of a fluid comprising a peroxide;

a gravel pack disposed between an outer diameter of the sand screen and an inner diameter of the well system, said gravel pack including a catalyst;

a sensor located on said conduit between said proximal and said distal ends; and a data line extending from said sensor to the surface connection.

119. A method for positionally releasing energy in a well system comprising:

disposing a continuous conduit into the well system from a reel, said continuous conduit having at least one reaction chamber on a distal portion;

injecting a fluid comprising a peroxide from a surface location through the continuous conduit and into contact with a catalyst disposed in the reaction chamber, said catalyst reacting with the fluid to release energy;

selectively releasing at least a portion of the released energy from the reaction chamber with at least one orifice providing an outlet for the reaction chamber; and moving the continuous conduit within the well system.

120. The method of claim 119 wherein the steps of selectively releasing and moving are simultaneous.

121. A method for positionally releasing energy in a well system comprising:

disposing a continuous conduit from a reel into the well system having at least one catalyst bed previously disposed therein;

injecting a fluid comprising peroxide from a surface location through the continuous conduit and into contact with the at least one catalyst bed to release energy in the well system; and moving the continuous conduit within the well system.

* * * * *